US005808644A

United States Patent [19]

Imamura et al.

[11] Patent Number: 5,808,644

[45] Date of Patent: Sep. 15, 1998

[54] METHOD FOR MANUFACTURING AN INK JET RECORDING HEAD HAVING INK FILTER

[75] Inventors: Isao Imamura, Yokohama; Tadayoshi Inamoto, Hachiohji, both of Japan

[73] Assignee: Canon Kabushiki Kaisha, Tokyo, Japan

[21] Appl. No.: 744,382

[22] Filed: Nov. 7, 1996

Related U.S. Application Data

[63] Continuation of Ser. No. 215,964, Mar. 18, 1994, abandoned, which is a continuation of Ser. No. 836,806, Feb. 19, 1992, abandoned.

[30] Foreign Application Priority Data

| | | | |
|---|---|---|---|
| Feb. 20, 1991 | [JP] | Japan | 3-045542 |
| Jun. 27, 1991 | [JP] | Japan | 3-157044 |
| Oct. 31, 1991 | [JP] | Japan | 3-286654 |

[51] Int. Cl.[6] ..... B41J 2/175

[52] U.S. Cl. ..... 347/93; 216/27; 347/65

[58] Field of Search ..... 347/65, 93; 216/27

[56] References Cited

U.S. PATENT DOCUMENTS

| | | | |
|---|---|---|---|
| 2,425,235 | 8/1947 | Ferrante | 210/507 X |
| 4,313,124 | 1/1982 | Hara . | |
| 4,317,124 | 2/1982 | Shirato | 347/67 |
| 4,345,262 | 8/1982 | Shirato et al. . | |
| 4,380,770 | 4/1983 | Maruyama | 347/93 X |
| 4,394,670 | 7/1983 | Sugitani et al. | 346/140 R |
| 4,459,600 | 7/1984 | Sato et al. . | |
| 4,463,359 | 7/1984 | Ayata et al. | 347/56 |
| 4,514,743 | 4/1985 | Roschlein et al. | 347/93 X |
| 4,558,333 | 12/1985 | Sugitani et al. . | |
| 4,639,748 | 1/1987 | Drake et al. | 347/93 X |
| 4,657,631 | 4/1987 | Noguchi | 347/65 X |
| 4,723,129 | 2/1988 | Endo et al. . | |
| 4,740,796 | 4/1988 | Endo et al. . | |
| 4,875,059 | 10/1989 | Masuda | 347/93 X |
| 4,897,674 | 1/1990 | Hirasawa | 347/65 |
| 5,030,317 | 7/1991 | Noguchi et al. | 347/65 X |
| 5,126,768 | 6/1992 | Nozawa et al. | 347/65 |

FOREIGN PATENT DOCUMENTS

| | | | |
|---|---|---|---|
| 0121894 | 10/1984 | European Pat. Off. | B41J 3/04 |
| 54-056847 | 5/1979 | Japan | B41M 5/26 |
| 59-123670 | 7/1984 | Japan | B41J 3/04 |
| 59-138461 | 8/1984 | Japan | B41J 3/04 |
| 60-071260 | 4/1985 | Japan | B41J 3/04 |
| 61-016864 | 1/1986 | Japan | B41J 3/04 |
| 1186331 | 7/1989 | Japan | B41J 3/04 |
| 3-202352 | 9/1991 | Japan | B41J 2/05 |
| 3202352 | 9/1991 | Japan | B41J 2/05 |

*Primary Examiner*—Joseph W. Hartary
*Attorney, Agent, or Firm*—Fitzpatrick, Cella, Harper & Scinto

[57] ABSTRACT

A method for manufacturing an ink jet recording head which includes a plurality of ejection outlets for ejecting ink; discrete ink passages communicating with respective ejection outlets; a common liquid passage communicating with the discrete ink passages for supplying ink thereto; a liquid chamber for supplying the ink to the common ink passages; and a filter. The filter includes plural projections between the common liquid passage and the liquid chamber, for preventing foreign matter from entering the discrete liquid passages. Adjacent projections define a liquid passing area having a size smaller than that of the ejection outlets.

3 Claims, 17 Drawing Sheets

METHOD FOR MANUFACTURING AN INK JET RECORDING HEAD HAVING INK FILTER

This application is a continuation of application Ser. No. 08/215,964, filed Mar. 18, 1994, now abandoned, which was a continuation of application Ser. No. 07/836,806, filed Feb. 19, 1992, now abandoned.

FIELD OF THE INVENTION AND RELATED ART

The present invention relates to an ink jet recording head, a recording apparatus using the same and a method for manufacturing the ink jet recording head, the recording head comprising ejection outlets, liquid passages communicating with the ejection outlets, ejection energy generating elements for generating energy for ejecting the ink through the ejection outlets and provided for the liquid passages and an ink supplying portion communicating with the liquid passages.

Referring first to FIG. 18, an ink jet recording head which will hereinafter be called simply "recording head" usable with an ink jet recording apparatus, generally comprises ejection outlets 16 through which ink is ejected, a liquid chamber 11 for containing the ink to be supplied to the ejection outlets 16, liquid passages 15 for communicating the ejection outlets 16 and the liquid chamber 11, energy generating elements provided for the respective liquid passages 15 to produce energy for ejecting the ink, and supply port 6 for externally supplying the ink to the liquid chamber 11.

In a known manufacturing method for such a recording head, the energy generating elements 2 are formed on a first base 1 by etching, evaporation, sputtering or the like. The first base is then covered with a positive or negative photosensitive dry film. The dry film is exposed to a negative or positive pattern corresponding to the ejection outlets 16, the liquid passages 15 and a part of the liquid chamber 11. Then, it is developed to provide on the first base a solid layer (not shown) corresponding to the ejection outlets 16, the liquid passages 15 and the part of the liquid chamber 11. Then, the solid layer and the first base 1 is covered with a proper thickness of active energy ray curing material 24 which is cured by active energy rays. Subsequently, a second base 4 which is capable of transmitting the active energy rays and which is provided with a recess 5 for providing the rest part of the liquid chamber 11 and for providing supply ports 6, is bonded on the active energy ray curing material 24 into a laminated structure so that the recess 5 is aligned with a position where the liquid chamber 11 is to be formed. The second base 4 is masked such that that portion of the active energy ray curing material 24 at which the liquid chamber 11 is to be formed, and the active energy ray curing material 24 is exposed to the active energy rays through the second base. The laminated structure in which the active energy ray curing material 24 is cured is cut at the position where the ejection outlets 16 are formed to expose an end surface of the solid layer. Then, it is dipped in a solvent capable of solving the solid layer and the uncured active energy ray curing material, by which the solid layer and the uncured material are solved out from the laminated structure, thus forming a space or spaces constituting the liquid passages 15 and the liquid chamber 11. This is disclosed in U.S. Pat. No. 4,657,631.

U.S. Pat. No. 5,030,317 discloses that a solid layer for forming the liquid passages and the liquid chamber is provided on a base plate; it is coated with active energy ray curing material; this is cured; and thereafter, the solid layer is removed. By doing so, a recording head having ejection outlets, liquid passages and a liquid chamber, can be produced.

U.S. Pat. No. 4,394,670 discloses a method for providing columnar or land portion or portions in the liquid chamber 11. FIG. 19 schematically illustrates one step in the manufacturing method. As shown in FIG. 19, a dry film photoresist is applied on a base having ink ejection pressure generating elements 2, and it is patterned and exposed. By doing so, the cured photoresist film 3H is provided while the ink ejection pressure generating elements 2 are exposed. Subsequently, in order to form the ink passages 15 and the ink supply chamber 11, the photoresist is applied on the cured photoresist film 3H, and is patterned by exposure.

By doing so, a cured film 5H provided the walls constituting the ink passages 15 and the walls constituting the ink supply chamber 11, are formed. At this time, lands 5Hi, 5Hj are formed at the position where the ink supply chamber 11 is formed.

The lands 5Hi and 5Hj are effective to provide support for preventing leakage, into the ink supply chamber, of the dry film applied on the cured film 5H, in the subsequent steps.

In the ink jet recording head manufactured through the above described step, the liquid supplied to the common chamber 11 is supplied into the liquid passages 15 by the capillary action. The liquid is stably maintained in the passages by the meniscus formed in each of the ejection outlets (orifice) at the leading end of the liquid passages. By supplying electric energy to the electrothermal transducers 2, the liquid on the electrothermal transducer surface is quickly heated, so that a bubble is created in the liquid passage. By the expansion and collapse of the bubble, the liquid is ejected through the ejection outlet 16 as a droplet or droplets. With the above described structure, 128, 256 or even more ejection outlets covering the entire recording width can be formed in an ink jet recording head at a density of 16 nozzles/mm.

In the Japanese Laid-Open Patent Application No. 202, 352/1991, buffers 25 and 26 are disposed upstream of the liquid passages to control the ink flow, as shown in FIG. 20, in order to improve the ink ejection frequency. The buffers 25 and 26, are formed by photolithographic technique using photosensitive resin material, as in U.S. Pat. No. 4,394,670 discussed hereinbefore.

However, it has been found that the recording head involves the following problems to be solved. Usually in ink jet recording heads, the cross-sectional area of the liquid passages is larger than that of the ejection outlet in order to stably supply the ink to the ejection outlet. When the ink contains foreign matters in the form of particles, and when the foreign matter is supplied to the ink passage, it arrives at the neighborhood of the ejection outlet. If this occurs, the direction of the ink ejection is deviated, or the amount of ink ejection varies with the result of non-uniformity. The ejection outlet, as the case may be, is clogged with the foreign matter with the result of ejection failure. The consideration to such possibility of clogging is not sufficient in the above-described ink jet recording head.

When an ink jet recording apparatus having the above-described conventional recording head shown in FIGS. 18 and 19 is placed on a vibrating table, and when a relatively large vibration is imposed thereto, the ink in the neighborhood of the ejection energy generating element or the ejection outlet is shifted to the ink container by the vibration, or air is introduced into the liquid passage through the ejection outlet, or the ink covers the ejection outlet surface, with the result of incapability of printing. Furthermore, the ink is leaked out of the ejection outlet to contaminate the neighborhood thereof by the vibration. In order to recover the proper printing operation, the recovering operation including the sucking of the ink through the ejection outlet by the pump, is required.

In the above-described ink jet recording head manufacturing method, the photoresist is applied on the base member, the walls for the liquid passages and the common liquid chamber 11 are provided by patterning the photoresist, and the lands 5Hi (FIG. 19) and the buffer walls 25 and 26 are also formed thereby. In addition, the top plate 4 is provided thereon, thus constituting the ink jet recording head. However, until the top plate is provided, they are bonded to the base only by the bonding force of the dry film, as shown in FIGS. 19 and 20. Therefore, it is possible that the walls are damaged. In order to increase the strength of the buffer walls 25 and 26 so as to be free from the damage, the sizes thereof are required to be larger than a predetermined size, and therefore, it is difficult to form fine buffer walls. From the standpoint of providing sufficient bonding strength between the top plate and the buffer walls, the buffer walls are required to have sizes larger than a certain size.

SUMMARY OF THE INVENTION

Accordingly, it is a principal object of the present invention to provide an ink jet recording head, a recording apparatus using the same and a manufacturing method for the same, wherein the ink jet ejection outlets do not receive foreign matters in the ink.

It is another object of the present invention to provide an ink jet recording head, a recording apparatus using the same and a manufacturing method for the same in which the printing is possible under vibrating condition or immediately after the impact applied thereto, with proper ink supply maintained.

It is a further object of the present invention to provide an ink jet recording head, an ink jet recording apparatus using same and a method for manufacturing the same, in which the ink jet recording head has such a structure without significantly increasing the number of parts and with simple manufacturing steps.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 3A and 3B illustrate an ink jet recording head manufacturing method according to an embodiment of the present invention, wherein FIG. 3A is a top plan view of the first substrate after the formation of the solid layer, and FIG. 3B are top plan views of a second substrate.

FIG. 4A is a sectional view taken along I–I' of FIG. 3A, FIG. 4B is a sectional view taken along II–II' of FIG. 3A, and FIG. 4C is a sectional view taken along III–III' of FIG. 3A.

FIG. 5A is a sectional view taken along I–I' of FIG. 3B, FIG. 5B is a sectional view taken along II–II' of FIG. 3, and FIG. 5C is a sectional view taken along III–III' of FIG. 3B.

FIG. 6A is a sectional view taken along I–I' of FIGS. 3A and 3B, FIG. 6B is a sectional view taken along II–II' of FIG. 3A and 3B, and FIG. 6C is a sectional view taken along III–III' of FIG. 3A and 3B.

FIG. 7A is a sectional view taken along I–I' of FIGS. 3A and 3B, FIG. 7B is a sectional view taken along II–II' of FIGS. 3A and 3B, and FIG. 7C is a sectional view taken along III–III' of FIGS. 3A and 3B.

DETAILED DESCRIPTION OF THE PREFERRED EMBODIMENTS

Referring to the accompanying drawings, the embodiments of the present invention will be described. The description will first be made as to the ink jet recording head (recording head).

Figure 1:
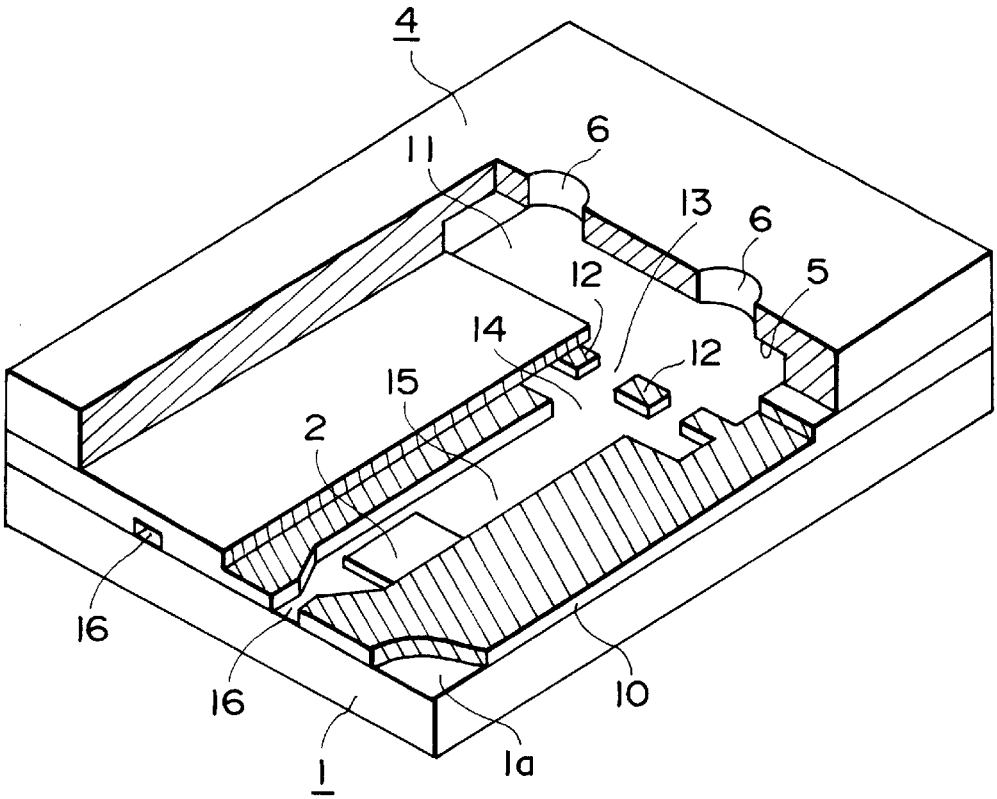
FIG. 1 is a partly broken perspective view of an ink jet recording head according to an embodiment of the present invention.

Referring to FIG. 1, on one surface of a first substrate made of glass, ceramic material, plastic resin material, metal or the like, ink ejection energy generating elements in the form of electrothermal transducers 2 are formed as thin layers with regular intervals manufactured through a semiconductor manufacturing process including etching, evaporation, sputtering or the like. The surface is an element surface 1*a*. To each of the electrothermal transducers 2, control signal input electrodes (not shown) for operating the electrothermal transducers 2 are connected. In response to the input signal through the electrodes, the electrothermal transducer elements 2 heat the ink in the neighborhood thereof, thus producing the ejection energy.

On the element surface 1*a*, a structure member 10 constituted by a single member cured by application of active energy rays, is laminated. In that surface of the structure member which faces the element surface 1*a*, plural discrete grooves are formed at the positions corresponding to the positions of the electrothermal transducer elements 2. The space defined by the discrete groove and the element surface 1*a* constitutes a discrete liquid passage 15. An end of the discrete groove has a reducing width and opens at an end of the structure member 10 to constitute a discrete ejection outlet 16. In the surface of the structure member 10 facing to the element surface 1*a* adjacent the other ends of the discrete grooves, a common groove communicating with the discrete grooves is formed to cooperate with the element surface 1*a* to provide a space constituting a common liquid passage 14. The liquid passage is provided by the common liquid passage 14 and the discrete liquid passages 15. In the middle of the common liquid passage 14, there are plural lands 12 arranged in parallel with the array of the ejection outlets 16, at regular intervals. The spaces between adjacent lands 12 function as openings 13 having a cross-sectional area smaller than the cross-sectional area of the ejection outlets 16.

Adjacent an end of the common liquid passage 14 of the structure member 10, an opening is formed with a bottom wall which is the element surface 1*a*. The opening cooperates with a recess 5 of a second substrate 4 laminated on the structure member 10 to constitute a liquid chamber 11. The liquid chamber 11 is provided for the purpose of stably supplying the ink to the ejection outlets, but the liquid chamber 11 is not necessarily required in this embodiment.

The second substrate 4 is provided with openings for communication between the liquid chamber 11 and an outside of the recording head, so that the ink supply ports 6 are formed. To the ink supply ports 6, supply pipes (not shown) are connected, and the supply pipes are connected to an unshown ink storage container. Therefore, the ink is supplied to the liquid chamber 11 from the ink storage container through the supply pipe.

The description will be made as to the operation for ejecting the ink through the ejection outlet 16. The ink supplied to the liquid chamber 11 and temporarily stored there, enters by the capillary action through the opening 13 to the discrete liquid passages 15. By formation of meniscus at each of the ejection outlets 16, the ink fills and is maintained in, the discrete liquid passages 15. When the electrothermal transducer 2 is supplied with electric energy through the electrodes (not shown), it produces heat. The ink on the electrothermal transducer element 2 is abruptly heated so that a bubble is created in the discrete liquid passage 15. By the expansion of the bubble, the ink is ejected through the ejection outlet 16. If the ink contains a foreign matter having a size larger than the cross-sectional area of the ejection outlet 16, the openings 13 function as a filter, and therefore, the foreign matter is blocked thereby. Thus, the improper ejection or ejection failure attributable to the foreign matter in the neighborhood of the ejection outlet, can be avoided. It should be noted that even if a part of the filter is clogged with the foreign matter, the discrete liquid passage can be supplied with the ink through the unclogged filter and through the common liquid passage.

A part of the wall of the liquid chamber 11, a part of the wall of the liquid passage 15, a part of the ejection outlets 16, a part of the wall of the common liquid passage 14 and the lands 12 are integrally formed.

In this embodiment, the liquid passage is provided by the common liquid passage 14 and the discrete liquid passages 15, and the openings 13 having the cross-sectional area smaller than that of the ejection outlets 16 are formed in the common liquid chamber 14. However, the provision of the common liquid passage 14 is not inevitable. In addition, the openings 13 may be provided at least at a part of the liquid passage.

In this embodiment, the energy generating element for producing the ink ejection is in the form of an electrothermal transducer element 2 connected with electrodes. However, this is not limiting, and a piezoelectric element for producing mechanical energy for applying instantaneous ejection pressure to the ink may be provided.

The number of ejection outlets 16 may be 128 or 256 at the density of 16 outlets per mm. A larger number of ejection outlets can be formed, for example, as many as covering the entire recording width for the recording material (full-line type).

The description will be made as to a recording head manufacturing method according to an embodiment of the present invention.

Figure 2:
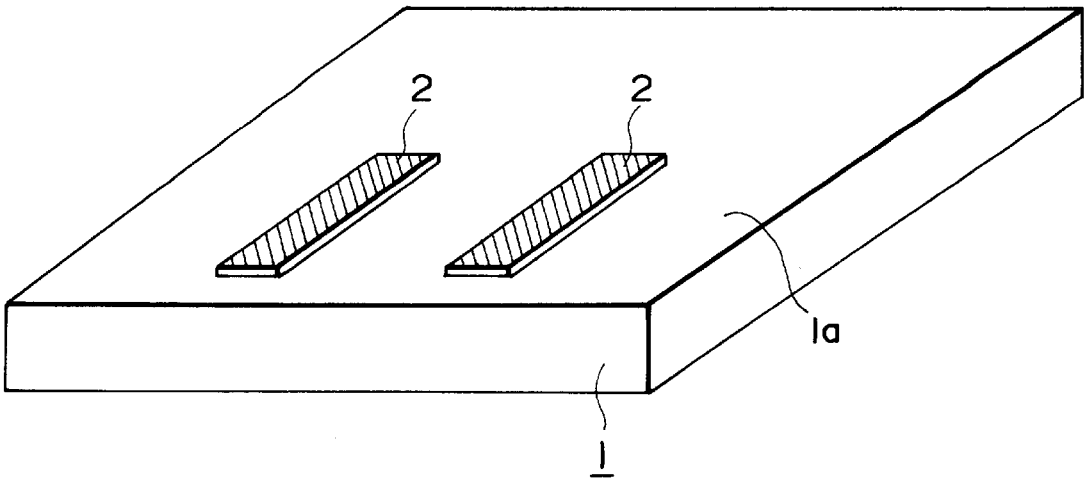
FIG. 2 is a perspective view of a first substrate before formation of a solid layer in an ink jet recording head manufacturing step according to an embodiment of the present invention.

As shown in FIG. 2, on an element surface 1*a* of the first substrate 1 made of glass, ceramic material, plastic resin material, metal or the like, electrothermal transducer elements 2 and control signal supply electrodes (not shown) for actuating the electrothermal transducers 2 are formed in the form of a film through a semiconductor manufacturing process including etching, evaporation, sputtering or the like. The electrothermal transducers 2 are disposed at regular intervals. In the description of this embodiment, only two energy generating elements are formed for simplicity of explanation. The number of energy generating elements and the number of corresponding liquid passage and the ejection outlets, is not limited to two. The number may be changed, as desired.

Although not shown in the Figure, the element surface 1*a* including the electrodes and the electrothermal transducer elements 2 may be coated with a function layer or function layers such as protection layer. This embodiment is effective irrespective of the presence or absence of the function layer or the material thereof.

The first substrate 1 functions as a part of the liquid passage wall and the liquid chamber wall, and also functions as a supporting member for the solid layer and the structure member. When the liquid chamber is used as in this embodiment, and when the active energy rays which will be described hereinafter are projected to the first substrate side, the first substrate is required to be transparent to the active energy rays. Otherwise, the configuration, material or the like of the first substrate 1 are not limited.

Figure 3B:
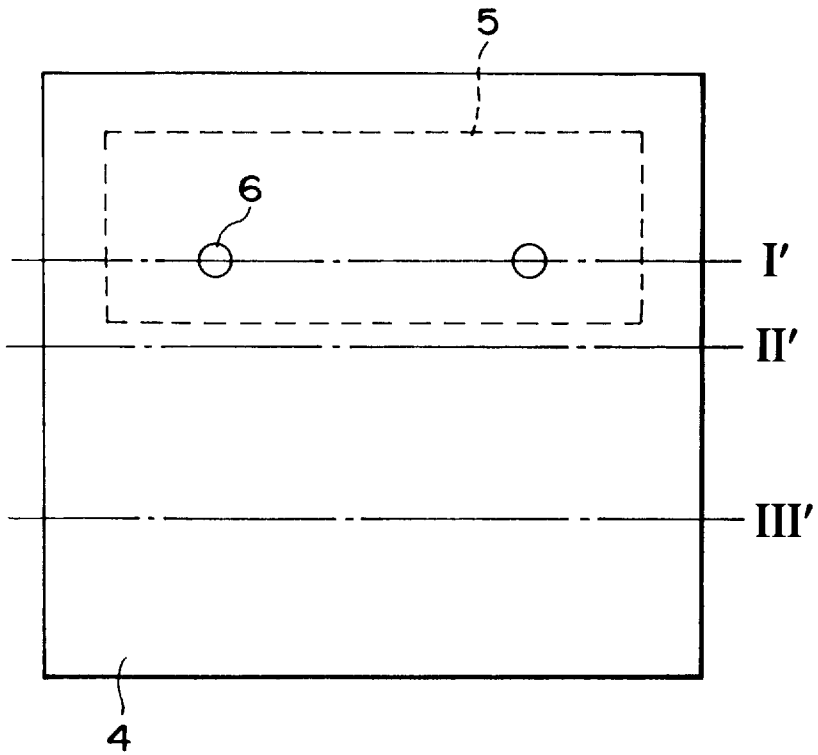
Figure 3A:
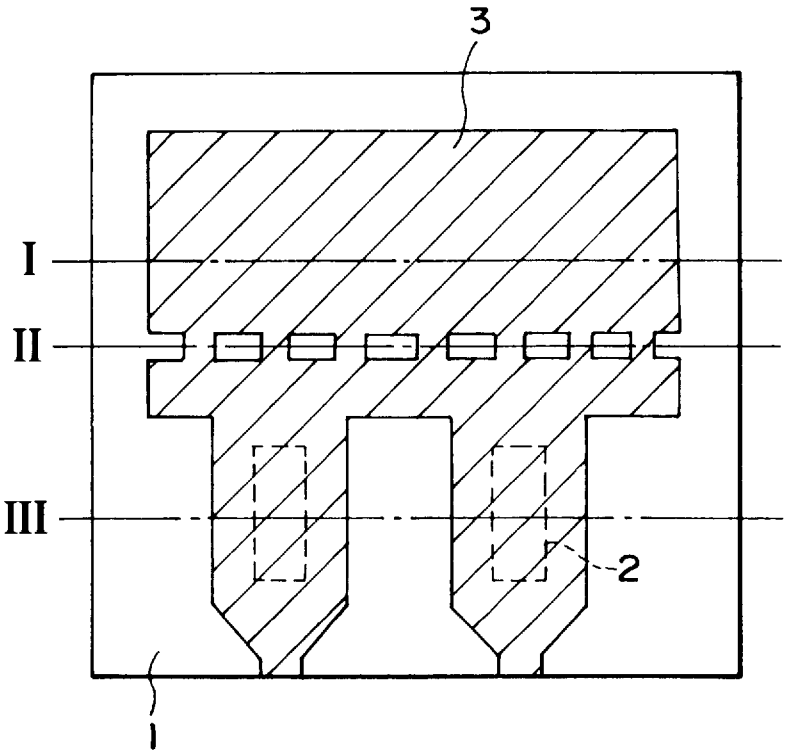

As shown in FIG. 3A, solid layers 3 are laminated on the element surface 1*a* at positions corresponding to the discrete liquid passages including the electrothermal transducer element 2, corresponding to the liquid chamber and corresponding to the openings (which will hereinafter be called "filter") which have cross-sectional areas smaller than that of the ejection outlets and which function to communicate between the discrete liquid passages and the liquid chamber. In this embodiment, the filter is in the common liquid chamber. FIG. 3B, shows an example of the second substrate 4. In this embodiment, the second substrate 4 is provided with a recess 5 and two supply ports 6 at the liquid chamber position.

FIGS. 4A, 5A, 6A and 7A show sectional views taken along line I–I' of FIGS. 3A and 3B; FIGS. 4B, 5B, 6B and 7B are sectional views taken along a line II–II' of FIGS. 3A and 3B; and FIGS. 4C, 5C, 6C and 7C show sectional views taken along a line III–III'.

The solid layers 3 are removed after the various steps which will be described hereinafter, and the removed portions constitute the liquid passage, the liquid chamber and the filter. The configuration of the liquid passage, the liquid chamber and the filter may be selected as desired, and the solid layers 3 are changed corresponding to the configurations of them. In this embodiment, the liquid passages are branched to two discrete passages so as to eject ink droplets from the respective two ejection outlets corresponding to the two electrothermal transducers 2. The liquid chamber communicates with the liquid passages to supply the ink to the respective passages.

The materials and means for forming the solid layers 3, are as follows:

(1) A photosensitive dry film is used; and the solid layers 3 are formed through image formation process on the dry film:

(2) On the first substrate 1, a desired thickness of dissolvable polymer layer and a photoresist layer are formed in this order; a pattern is formed on the photoresist layer; and the dissolvable polymer layer is selectively removed:

(3) A resin material is printed.

As for the photosensitive dry film mentioned to in paragraph (1), a positive or negative film is usable. The usable positive dry film includes the one which becomes soluble in a developing liquid by application of active energy rays. The usable negative dry film includes photopolymerizing methylene chloride or the negative dry film soluble or removable by strong alkali.

More particularly, the positive dry film includes OZATAC R225 (trade name, available from Hoechst Japan Kabushiki Kaisha, and the negative dry film includes OZATAC T series (trade name, available from Hoechst Japan Kabushiki Kaisha), PHOTAC PHT series (trade name, available from Hitachi Kasei Kogyo Kabushiki Kaisha, Japan), RISTON (trade name, available from Du Pont de Nemours & Co., Ltd.).

As well as those materials which are commercially available, the following compositions can be also similarly usable: resin compositions which positively act, for example, resin compositions mainly consisting of naphthoquinone diozide derivative and a novolak type phenol resin; resin compositions which negatively act, e.g., compositions mainly consisting of acrylic oligomer which uses acrylic ester as a reactive radical, a thermoplastic high polymer compound, and a sensitizer; compositions consisting of polythiol, a polyene compound, and a sensitizer; or the like.

As a solvent soluble polymer mentioned in the item (2), it is possible to use any high polymer compound such that the solvent which can dissolve it exists and a coating film can be formed by a coating process. As a photoresist layer which can be used in this embodiment, the following layers can be typically mentioned: a positive type liquid photoresistor consisting of novolak type phenol resin and naphthoquinone diozide; a negative type liquid photoresist consisting of a polyvinyl cinnamate; a negative type liquid photoresist consisting of a cyclized rubber and bis azide; a negative type photosensitive dry film; a thermosetting type and ultraviolet ray hardening type inks; and the like.

As a material to form the solid layer by the printing method mentioned in the item (3), it is possible to use a lithographic ink, a screen ink, a printing type resin, and the like which are used in each of the drying systems of, e.g., the evaporation drying type, thermosetting type, ultraviolet ray hardening type, and the like.

Among the foregoing groups of materials, using the photosensitive dry film mentioned in the item (1) is preferable in consideration of the working accuracy, ease of removal, working efficiency, and the like. Among them, it is particularly desirable to use the positive type dry film. Namely, for example, the positive type photosensitive material has such features that the resolution is superior to that of the negative type photosensitive material and the relief pattern can be easily formed so as to have the vertical and smooth side wall surface or the tapered or reverse tapered type cross sectional shape, and it is optimally forms the liquid channel. On the other hand, there are features such that the relief pattern can be dissolved and removed by a developing liquid or an organic solvent, and the like. In particular, in the case of the positive type photosensitive material using, e.g., naphthoquinone diazide and novolak type phenol resin mentioned above, it can be completely dissolved by weak alkali aqueous solution or alcohol. Therefore, no damage is caused in the emission energy generating element and at the same time, this material can be removed quickly in the post process. Among the positive type photosensitive materials, the dry film shaped material is the most desirable material because its thickness can be set to 10 to 100 $\mu$m.

Figure 4A:
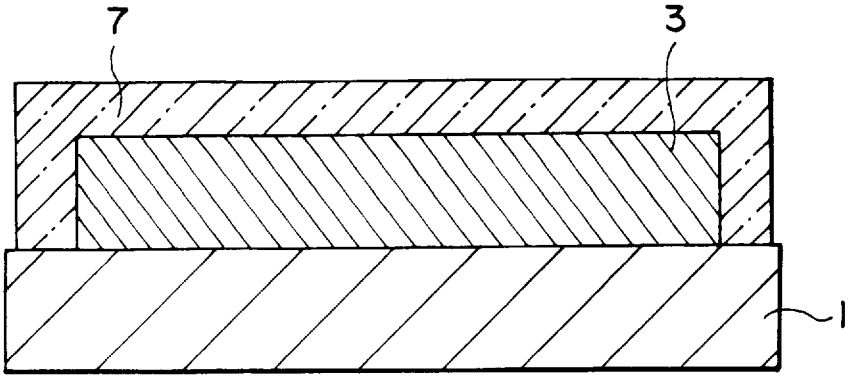
FIGS. 4A, 4B and 4C is a sectional view of the first substrate after the solid layer and active energy ray curing material are laminated in an ink jet recording head manufacturing method according to an embodiment of the present invention.
Figure 4B:
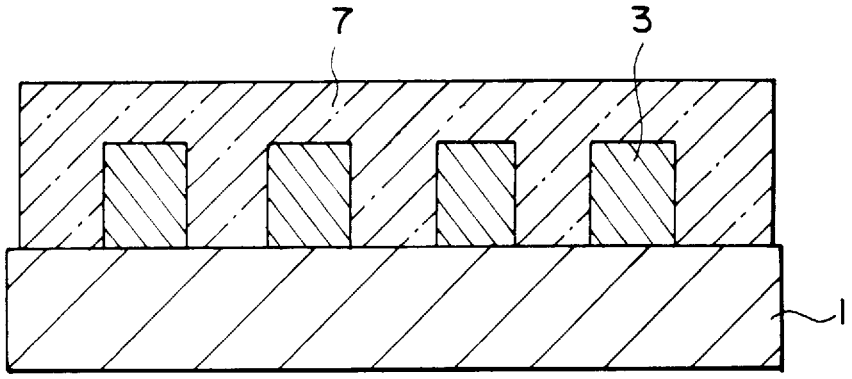
Figure 4C:
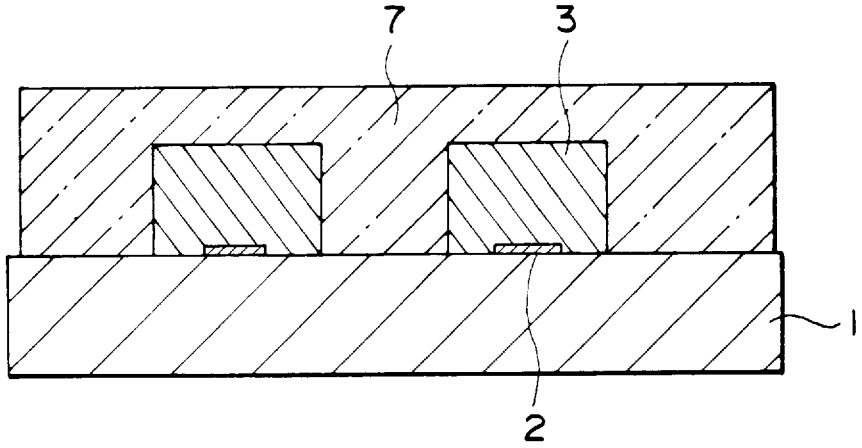

As shown in FIGS. 4A, 4B, 4C, on the first substrate 1 having the solid layer 3, an active energy curing or hardening material 7 is laminated to cover the solid layer 3. The hardening material 7 will become the structure member or structural material after being hardened by the active energy rays.

As the structure member or the structural material, it is possible to preferably use any material which can cover the solid layers. However, since this material is used as a structural material serving as a liquid jet recording head by forming the liquid channel and liquid chamber, it is desirable to select and use a material which is excellent with respect to the adhesive property with the substrate, mechanical strength, dimensional stability, and corrosion resistance. As practical examples of such materials, active energy ray hardening liquid materials which are hardened by the ultraviolet rays and an electron beam are suitable. Among then, there is usable epoxy resin, acrylic resin, diglycol dialkyl carbonate resin, unsaturated polyester resin, polyurethane resin, polyimide resin, melamine resin, phenol resin, urea resin, or the like. In particular, the epoxy resin which can start the cationic polymerization by the light, acrylic oligomer group having an acrylic ester which can radical polymerize by the use of light, photo addition polymerization type resin using polythior and polyene, unsaturated cycloacetal resin, and the like are suitable as a structural material since the polymerizing speed is high and the physical property of the polymer is also excellent.

As a practical method of laminating the active energy beam hardening material, for example, it is possible to laminate it by the means such as discharge instrument using a nozzle of the shape according to the shape of the substrate, applicator, curtain coater, roll coater, spray coater, spin coater, or the like. When a liquid hardening material is laminated, it is preferable to laminate it so as to avoid the mixture of air bubbles after such material was degasified.

Figure 5A:
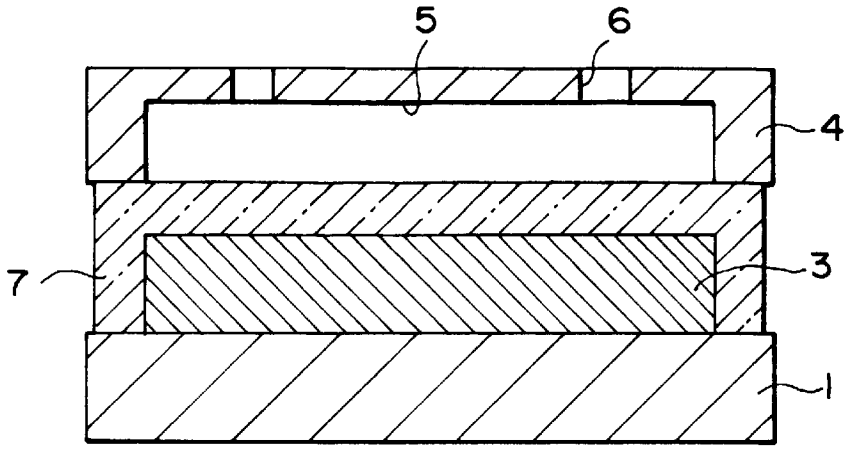
FIGS. 5A, 5B and 5C are sectional views of the laminated layer of the second substrate in a manufacturing method of the ink jet recording head according to the embodiment of the present invention.
Figure 5B:
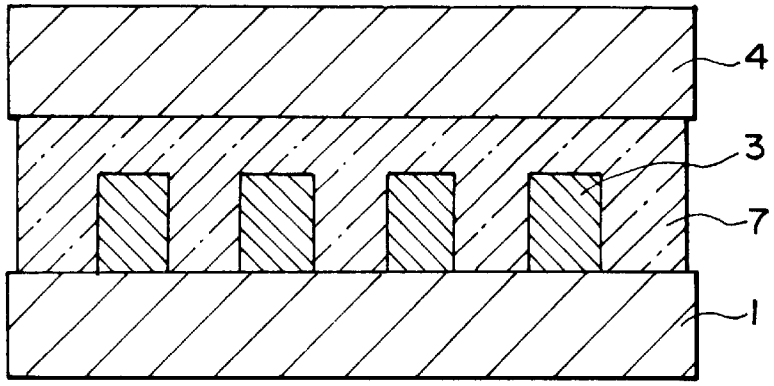
Figure 5C:
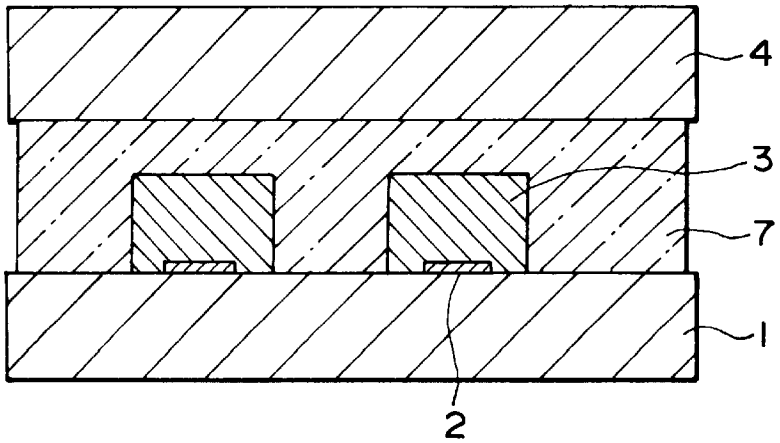

Next, the second substrate 4 is laminated onto the active energy beam hardening material layer 7 on the first substrate 1 as shown in FIGS. 5A, 5B and 5C. The second substrate 4 is not inevitable to this invention. In this case, a concave portion adapted to obtain a desired volume of the liquid chamber may be also formed in the portion of the liquid chamber forming portion of the second substrate 4 as necessary. Similarly to the first substrate 1, a desired material such as glass, plastic, photosensitive resin, metal, ceramics, or the like may be also used as the second substrate 4. However, in the case of performing the process to irradiate active energy rays from the side of the second substrate 2, the active energy beam needs to be transmitted. In addition, a port or ports to supply a recording liquid may be also be previously formed in the second substrate 4.

Although not shown in the above description, the active energy beam hardening material layer 7 may also be laminated after the second substrate was laminated onto the solid layer. As a laminating method in this case, it is desirable to use a method wherein after the second substrate 4 was pressure adhered to the first substrate 1, the inside pressure is reduced and then the hardening material is injected, or the like. On the other hand, when the second substrate 4 is laminated, in order to set the thickness of the layer 7 to a desired value, it is also possible to use a method wherein, for example, a spacer is sandwiched between the first and second substrates, a convex portion is formed at the edge of the second substrate 4, or the like.

Figure 6A:
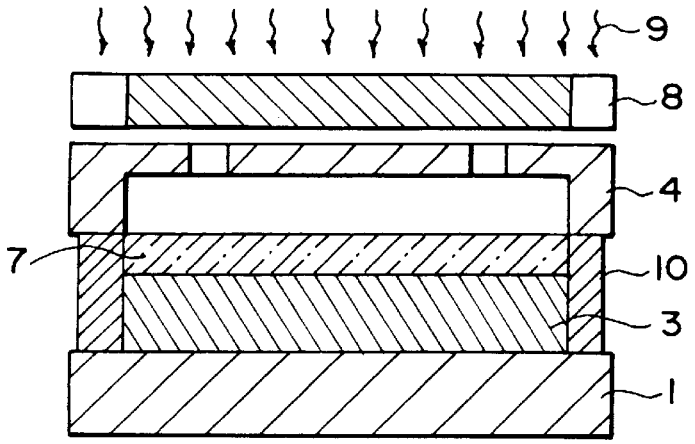
FIGS. 6A, 6B and 6C are sectional views of the laminated layer after the masking layer is laminated in the ink jet recording head manufacturing method according to the embodiment of the present invention.
Figure 6B:
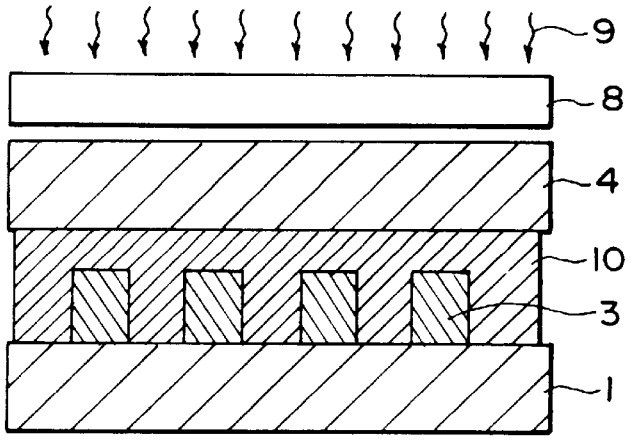
Figure 6C:
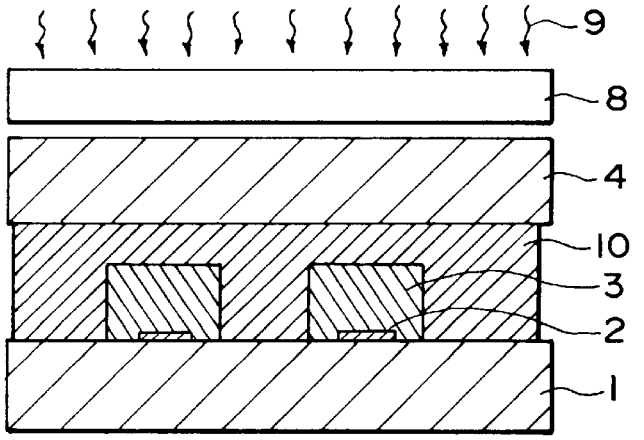

In this manner, the first substrate 1, solid layer 3, active energy ray hardening material layer, and second substrate 4 are sequentially laminated to form a single laminate. Thereafter, as shown in FIGS. 6A, 6B and 6C, a mask 8 is laminated onto the side of the substrate capable of transmitting the active energy beam (in this example, the second substrate 4) so as to shield the liquid chamber forming portion from an active energy beam 9. Then, the active energy beam 9 is irradiated from above the mask 8 (the hatched area in the mask 8 shown in the Figure) does not transmit the active energy beam and the area other than the black area can transmit the active energy beam). By irradiating the active energy beam 9, the active energy beam hardening material (the hatched portion indicated at reference numeral 10 in the diagram) corresponding to the irradiated portion is hardened, so that the hardened resin layer is formed. At the same time, the first and second substrates 1 and 4 are joined by this hardening. The active energy ray hardening material is not hardened in the area not exposed to the energy rays 9.

It is another alternative that the first substrate is made of a material permitting transmission of the active energy rays 9, and the active energy rays 9 are projected to the first substrate 1.

Ultraviolet rays, electron beam, visible rays, or the like can be used as an active energy beam. However, since the exposure is performed by transmitting the active energy beam through the substrates, the ultraviolet rays and the visible rays are preferable. The ultraviolet rays are the most suitable in terms of the polymerizing speed. As a source for emitting ultraviolet rays, it is desirable to use the light rays having a high energy density, such as high pressure mercury lamp, extra-high pressure mercury lamp, halogen lamp, xenon lamp, metal halide lamp, carbon arc, or the like. As the light beam emitted from the light source is highly parallel and as its heat generation is low, the working accuracy becomes high. However, it is possible to use an ultraviolet ray light source which is generally used for the print photoengraving, working of a printed wiring board, and hardening of a light hardening type coating material.

As a mask for the active energy beam, in particularly, in the case of using the ultraviolet rays or visible rays, it is possible to use a metal mask, an emulsion mask of silver salt, a diazo mask, or the like. Further, it is also possible to use a method whereby a black ink layer is merely printed to the liquid chamber forming portion, or a seal is merely adhered thereto, or the like.

For example, when the edge surface of the orifice is not exposed, or the like, the laminate after it was hardened by the irradiation of the active energy beam is cut at a desired position as necessary by a dicing saw or the like using a diamond blade, thereby exposing the orifice edge surface. However, such a cutting is not always necessary to embody the present invention. The cutting work is unnecessary in the case where, for example, a liquid hardening material is used, a die is used when this material is laminated, the orifice edge portion is smoothly molded without closing and covering the orifice edge portion, or the like.

Figure 7A:
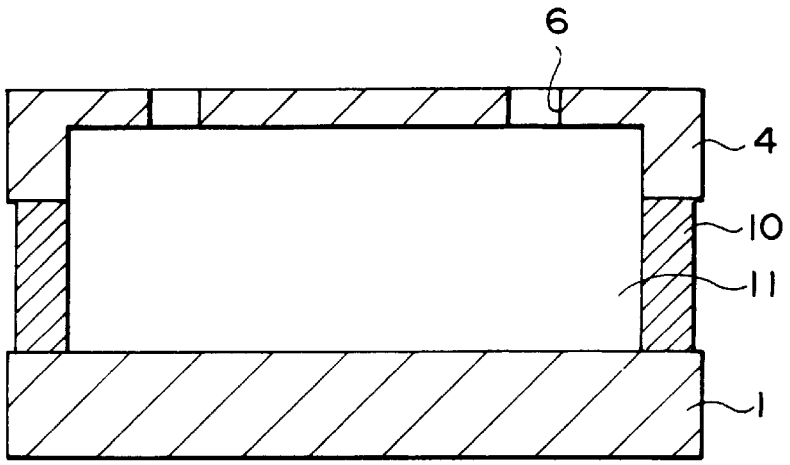
FIGS. 7A, 7B and 7C are sectional views of the laminated layer after the solid layer and the uncured curing material are removed in the ink jet recording head manufacturing process according to an embodiment of the present invention.
Figure 7B:
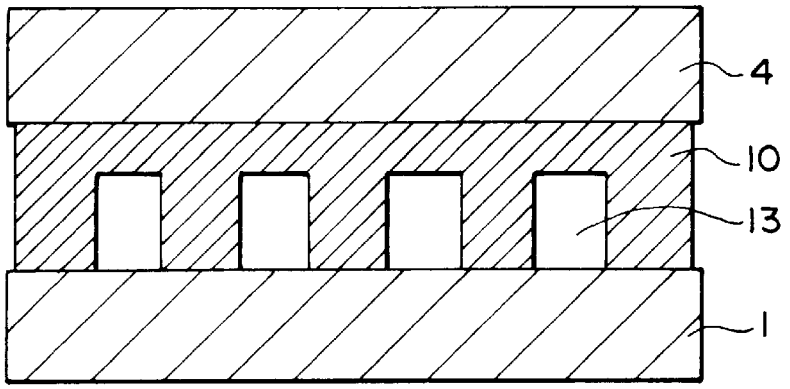
Figure 7C:
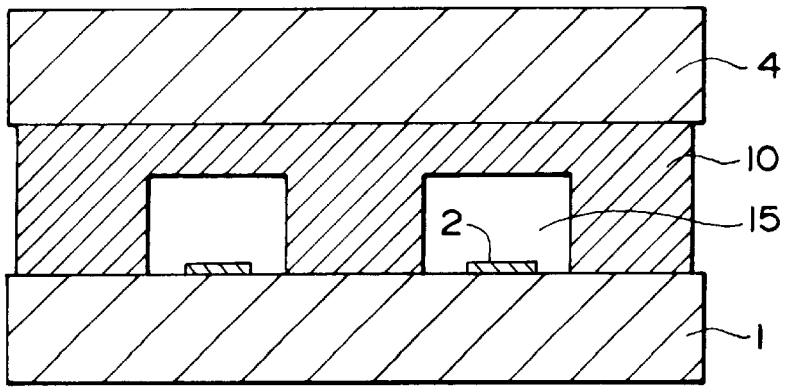

Next, as shown in FIGS. 7A, 7B and 7C, the solid layer 3 and the material 7 which is not yet hardened are removed from the laminate after completing the irradiation of the active energy beam, thereby forming discrete passages 15 and the common passage 14 having the liquid chamber 11 and the opening (filter) 13 (FIG. 1).

The means for removing the solid layer 3 and the hardening material 7 (FIG. 6) is not limited in particular. However, practically speaking, it is preferable to use a method wherein, for example, the solid layer 3 and the hardening material in the unhardened state are dipped into a liquid which is selected to dissolve, swell, or peel them, thereby removing them, or the like. In this case, it may also be necessary to use the removal promoting means such as ultrasonic wave process, spray, heating, stirring, shaking, pressure circulation, or the like.

As a liquid which is used for the above removing means, it is possible to use, for example, halogen containing hydrocarbon, ketone, ester, aromatic hydrocarbon, ether, alcohol, N-methyl pyrrolidone, dimethyl formamide, phenol, water, water containing acid or alkali, or the like. A surface active agent may be also added to those liquids as necessary. On the other hand, when a positive type dry film is used as a solid layer, it is desirable to again irradiate the ultraviolet rays to the solid layer so as to make the removal easy. In the case of using other material, it is preferable to heat the liquid to a temperature within a range of 40° to 60° C.

FIGS. 7A, 7B and 7C show the state after the solid layer 3 and the active energy beam hardening material 7 in the unhardened state were removed. However, in the case of this example, the solid layer 3 and the unhardened material 7 are dipped into the liquid adapted to dissolve them and are dissolved and removed through the orifice 13 of the head and the liquid supply port 6. After the completion of the above steps, in order to optimize the interval between the ejection outlets 16 and the ejection energy generating elements 2, the ejection outlet 13 portion may be cut out, abraded or smoothed, as desired.

In the foregoing embodiment of the ink jet recording head, the solid layer 3 is not required to extend to the position corresponding to the liquid chamber 11, on the first substrate 1. It will suffice if it extends at least to the portion corresponding to the liquid passages 15 and the common liquid passage 15. As for the ink jet recording head of this embodiment, the second substrate 4 is not inevitable. In addition, the liquid chamber 11 is not inevitable. In place of the liquid chamber 11, it is possible to use a structure for properly supplying the ink to the liquid passages 15.

The description will be made as to the examples of this embodiment. Prior to the experiments, 5 groups of recording heads having different cross-sectional areas of the filter openings or apertures (100 recording heads for each group) were manufactured in accordance with the process steps described in conjunction with FIGS. 2–7C, as shown in the following table 1.

TABLE 1

| | Filter aperture area ($\mu m^2$) (width × height) |
|---|---|
| 1 (Example 1) | 1500 (30 × 50) |
| 2 (Example 2) | 2000 (40 × 50) |
| 3 (Example 3) | 2250 (45 × 50) |
| 4 (Comp. Ex. 1) | 2500 (50 × 50) |
| 5 (Comp. Ex. 2) | 2750 (55 × 50) |
| 6. (Comp. Ex. 3) | 3000 (60 × 50) |
| 7 (Comp. Ex. 4) | No filter |

The cross-sectional area of the ejection outlets of the recording heads of the above examples and comparison examples were all 2500 $\mu m^2$ ($50\mu \times 50\mu$).

The description will be made as to the manufacturing process of the recording heads.

First, an electrothermal transducer (made of $HfB_2$) as a liquid ejection energy generating element was formed on a glass substrate (having a thickness of 1.1 mm) as a first substrate. Then, a photosensitive layer having a thickness of 50 $\mu m$ consisting of a positive type dry film "OZATEC R225" (made by Hoechst Japan Co., Ltd.) was laminated onto the first substrate. A mask of a pattern corresponding to the configuration of the liquid passages was overlaid onto the photosensitive layer. The ultraviolet rays of 70 mJ/$cm^2$ were irradiated to the portion excluding the portions where a liquid passage, a liquid chamber and a filter will be formed.

Next, the spray development was performed using a sodium metasilicate aqueous solution of 5%. A relief solid layer having a thickness of about 50 $\mu m$ was formed in the liquid passages and liquid chamber forming portions on the glass substrate including the electrothermal transducer.

One hundred substrates (500 in total) on each of which the solid layer has been laminated in accordance with Table 1 were formed in accordance with the operating procedure similar to the above. Active energy ray hardening liquid material (epoxy resin "Cyracure UVR 6110", available from Japan Union Carbide Kabushiki Kaisha) were laminated onto the substrates formed with the solid layers. The operating procedure was as follows.

The active energy beam hardening material was mixed to the catalyst (triphenyl honium hexafluoroantimonate) and was defoamed using a vacuum pump. Thereafter, the three defoamed materials were coated on the first substrates on which the solid layers had been laminated so as to have thicknesses of 70 $\mu m$ from the upper surfaces of the substrates by using the applicator.

Next, a glass substrate as a second substrate having a thickness of 1.1 $\mu m$ was laminated onto each of the first substrates on which the foregoing three kinds of active energy ray hardening materials had been laminated in accordance with the position of the liquid chamber forming portion. Each of the glass substrates has a concave portion of a depth of 0.3 mm in the liquid chamber forming portion and a through hole (liquid supply port) to supply the recording liquid at the center of the concave portion.

Subsequently, a film mask was adhered onto the upper surface of the second substrate of the laminate. The light beams were irradiated from the above of the liquid chamber forming portion by the extra-high pressure mercury lamp "UNIARC (trade name)" (made by Ushio Inc.) by shielding the liquid chamber forming portion against the active energy rays. At this time, the integrated intensity of light near 365 nm was 1000 mW/$cm^2$. Next, the film mask was removed and the orifice was cut such that the electrothermal transducer is located at the position away by 0.1 mm from the orifice edge, thereby forming the orifice edge surface.

The 500 laminates having the exposed orifice edge surfaces were each dipped into ethanol. Ethanol was filled in the liquid chamber. The dissolving and removing process was executed in the ultrasonic cleaner for about three minutes in the state in which the orifice edge surfaces are in contact with ethanol. After completion of the dissolution and removal, the cleaning was performed using an NaOH aqueous solution of 5% and pure water. Thereafter, those laminates were dried and exposed at the rate of 10 J/$cm^2$ by use of the high pressure mercury lamp. In this way, the active energy ray hardening materials were completely hardened.

The residue of the solid layer did not exist at all in any of the liquid passages of the 100 liquid jet recording heads which had been made as described above. Further, these heads were attached to the recording apparatus and the recording was executed using an ink for ink jet consisting of pure water/glycerol/direct black 154 (water-soluble black dye) at 65/30/5 (weight parts), so that the printing was performed. The results of the experiments are summarized in the following Table 2.

TABLE 2

| Example No. | Frequency of nozzle clogging | No ejection | Deviation |
|---|---|---|---|
| 1 | 3/100 | 0 | 3 |
| 2 | 5/100 | 0 | 5 |
| 3 | 6/100 | 0 | 6 |
| 4 | 13/100 | 1 | 9 |
| 5 | 15/100 | 2 | 8 |
| 6 | 18/100 | 3 | 7 |
| 7 | 29/100 | 7 | 18 |

In Table 2, "nozzle clogging" means that the foreign matters clogging in the discrete liquid passage are observed by a microscope. The frequency thereof means the number of clogged discrete passages/the number of recording heads. The "no ejection" means the ejection failure in which the foreign matter in the liquid passage prevents ejection of the ink (number of occurrences). The "deviation" means that the ejection force decreases because of the foreign matter in the discrete liquid passage, and therefore, the ink is not ejected straight.

It will be understood from Table 2 that the provision of the filter in the liquid passage is effective to significantly increase the nozzle clogging and the ejection failure or deviation of the ink during the printing. In addition, it will be understood that the effects are more significant with the increase of the cross-sectional area of the filter apertures. It will also be understood that the effects are remarkable if the cross-sectional area of the filter apertures is smaller than the cross-sectional area of the ejection outlets.

Another embodiment of the ink jet recording head and another embodiment of the manufacturing method therefor will be described in which the smaller foreign matters and elongated foreign matters are efficiently removed by a filter.

In the foregoing embodiment, relatively large foreign matters are prevented from reaching the ejection outlets by the provision of the lands (filter) at the boundary between the liquid chamber and the common passage, wherein the cross-sectional area of the apertures of the filter is smaller than the cross-sectional are of the ejection outlets.

The foreign matters may contain smaller or elongated foreign matters. Most of these foreign matters are ejected together with the ink through the ejection outlets, and rarely clogs the ejection outlets. However, in the case where the amount of the foreign matters is large or where elongated or flat foreign matters which may taken different positions in the passage, can disturb the direction of the ink ejection at the position of the ejection outlets with the result of deterioration of the image quality. It will be considered that the intervals between the lands in the foregoing embodiments are reduced in order to remove such foreign matters. However, since the lands are formed by photolithographic process, and therefore, it is difficult to decrease the intervals down to a predetermined level. Moreover, it is difficult to decrease the area of the clearance between adjacent lands in the direction of the height thereof. If the cross-sectional area thereof is too small, the resistance against the ink flow increases with the result of poor supply of the ink to the liquid passage even to the extent of the possible improper ink ejection.

In order to further improve the image quality, it is desirable that the filter comprises filler materials as in this embodiment. The description will be made as to the structure and the manufacturing method.

Figure 8:
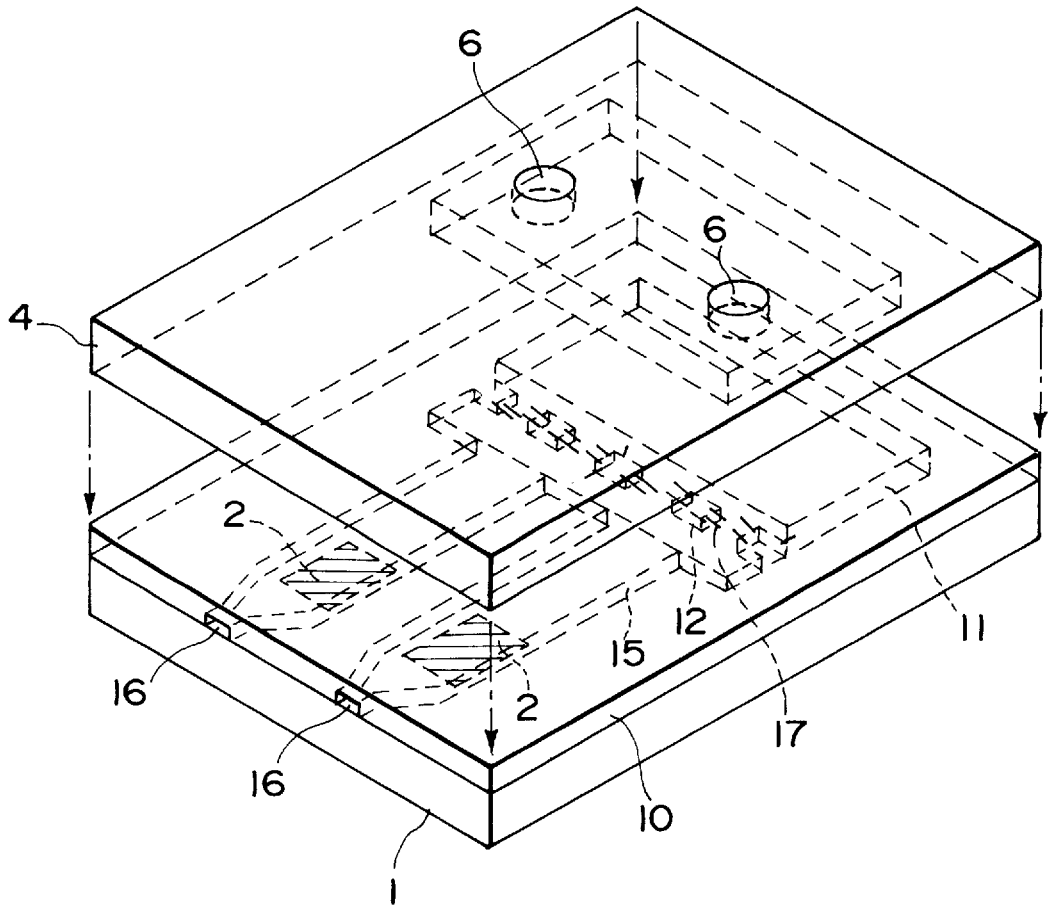
FIG. 8 is a perspective view of the manufactured ink jet recording head according to an embodiment of the present invention.
Figure 9:
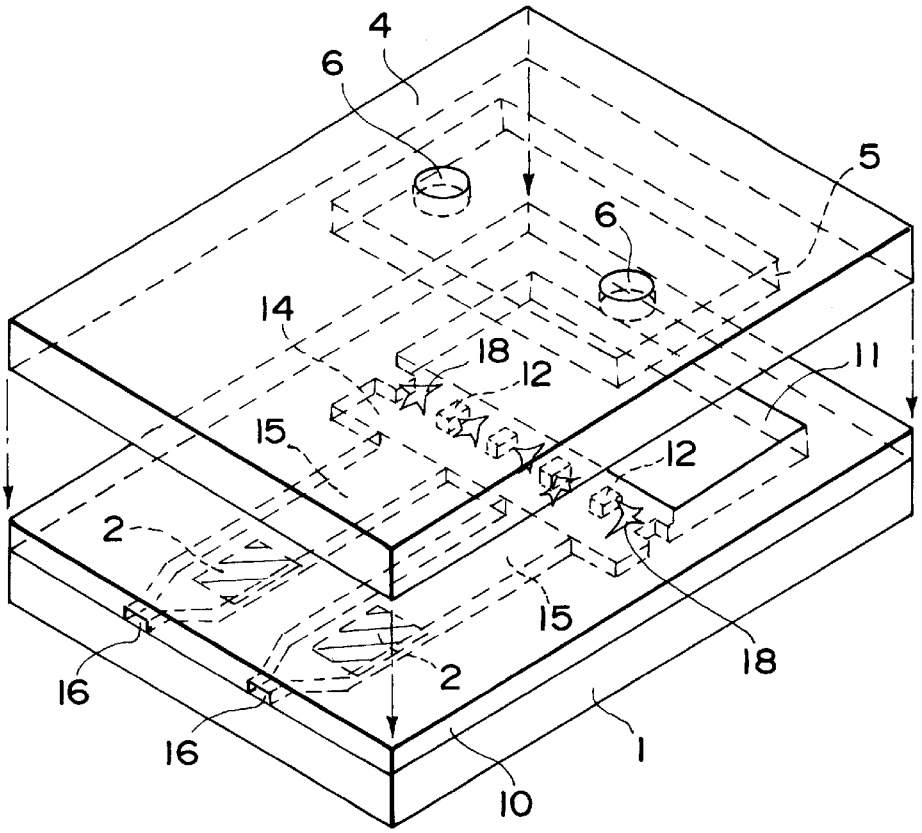
FIG. 9 is a perspective view of an ink jet recording head according to an embodiment of the present invention.
Figure 10:
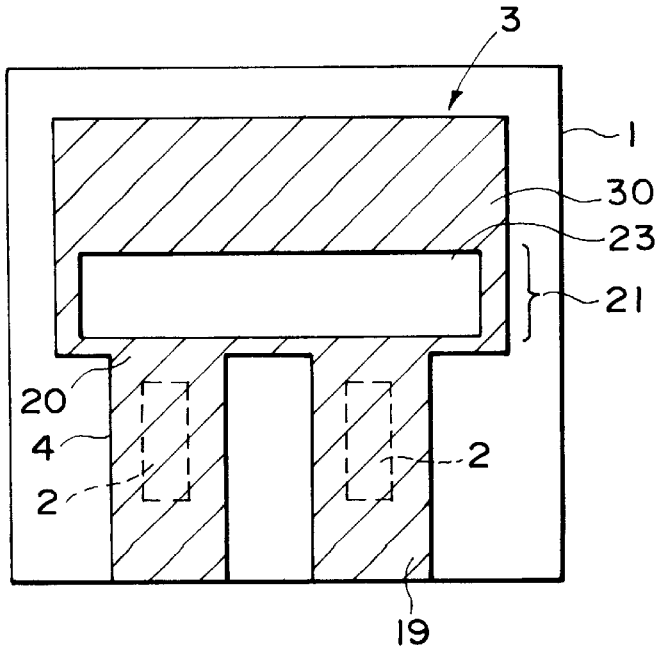
FIG. 10 is a top plan view of the ink jet recording head when a first solid layer is formed on a first substrate.

Referring to FIGS. 8 and 9, there is shown perspective views of the ink jet recording head according to this embodiment. FIGS. 10, 11A, 11B, 12A, 12B, 12C and 12D illustrate the manufacturing method of the ink jet recording head of this embodiment. FIGS. 12A, 12B and 12C show cross-sectional views taken along the lines IV–IV', V–V', VI–VI', VII–VII', VIII–VIII'; and IX–IX', respectively of FIGS. 11A and 12B. In these Figures, the ink jet recording head is shown as having two ejection outlets. However, the ink jet recording head may be provided with three or more ejection outlet at a high density. Also, the present invention is usable in the case in which the ink jet recording head has only one ejection outlet.

In FIGS. 8 and 9, the substrate which is similar to the substrate used in the foregoing embodiment, linear liquid passages 15 are formed corresponding to the associated ejection energy generating elements 2. The ejection energy generating elements 2 are mounted on the bottom of the liquid passage 15. An end of each of the liquid passages 15 is reduced and opens to the outside, thus constituting ejection outlet 16. Each of the other ends of the liquid passages 15 communicates with a liquid chamber 11 commonly provided for the liquid passages 15. The liquid chamber 11 cooperates with the liquid supply port or ports 6 which will be described hereinafter to constitute an ink supply portion for supplying the ink to the liquid passages 15. The portion of the liquid passages communicating with the liquid chamber 11 is in the form of a common liquid passage 14 to which the plural liquid passages 15 merge. The common liquid passage 14 is provided with a proper number of lands 12 (columnar portions) connecting the bottom wall of the common liquid passage 14 (the first substrate 1) and the ceiling. Between the adjacent lands, needle-like filler materials 17 and/or three dimensional filler 18 are disposed. The filler materials 17 and 18 function as filtering elements for the ink supplied to the liquid passage 15 from the liquid chamber 11. Therefore, the ink is forced to pass through the filter consisting of the filler materials 17. The bottom portion of the liquid chamber 11, the liquid passages 15, the ejection outlets 16, the common liquid passage 14 and the lands 12 are integrally formed with the filler material 10. On the top surface of the filler material 10, the second substrate 4 is provided.

In the bottom surface of the second substrate 4, a recess 5 corresponding to the upper portion of the liquid chamber 11 is formed, and the recess 5 is provided with a liquid supply port 6 communicating with the top surface of the second substrate 2 and is formed to permit ink supply to the liquid chamber 11 from the outside thereof.

The description will be made as to the operation of the ink jet recording head of this embodiment. The ink which is the recording liquid material is supplied to the liquid chamber 11 through the liquid supply port 6 through a liquid storage container not shown. The ink supplied to the liquid chamber 11 is supplied to the discrete liquid passages 15 through the common liquid passage 14 by capillary action. The ink is retained stably in the liquid passages 15 by the formation of the meniscus at each of the ejection outlets 16. Since the common liquid passage 14 is provided with the filler materials 17 and 18 constituting the filter, the solid foreign matters if any in the ink are prevented from entering the liquid passages 15. Therefore, the liquid passages 15 or the narrower ejection outlets 16 at the downstream ends thereof are protected from being clogged with the foreign matters. The ejection energy generating elements 2 are actuated by an unshown driving means, so that the ejection energy is applied to the ink so as to eject the ink through the ejection outlets 16.

The manufacturing method of the ink jet recording head of this embodiment will be described. The same process steps as in the first embodiment will be omitted for the purpose of simplicity of explanation.

As shown in FIG. 9, a first substrate having a desired number of ejection energy generating elements 2 at the proper portion on the surface thereof, is prepared. On such a substrate 1, a first solid layer 3 is formed as shown in FIG. 2. The solid layer 3 is integral containing the liquid passage portions 20, the filter forming portion 21 and the liquid chamber forming portion 22, in this order.

The liquid passage portions 4 extend in the form of stripes above the ejection energy generating elements 2 on the top surface of the substrate 1. One end 7 of each of them is connected to the filter forming portion 21. The filter forming portion 21 is provided with rectangular cavities 23 without the solid layer material.

The material and means used for the formation of the solid layer 3 are the same as in the foregoing embodiment. The cavities constituting the filter are formed in the following manner. When the solid layer is of positive dry film, the material is masked with a mask covering the portion other than the cavity forming portions, and thereafter, the exposure, development and removal processes are carried out to provide the cavities 23. If the solid layer is of negative dry film, on the other hand, the cavity forming positions are masked, and the exposure, development and removal processes are carried out so as to provide the cavities 23.

Subsequently, resin material sensitive to active energy rays containing the filler material is dispensed into the cavities 23 of the first solid layer 3 thus formed. The method for accomplishing this will be described. In one method, the filler materials 17 and 18 are added and mixed into the material constituting the solid layer 3, beforehand. The mixed material is dispensed to the cavities 23. In another method, after the formation of the solid layer 3, the cavities are not formed, and the filler materials 17 and 18 are placed on the surface of the solid layer 3 at the positions corresponding to the filter forming position. Then, the solid layer 3 is heated and softened, and the filler materials 17 and 18 are pressed so as to be embedded into the solid layer 3. At this time, it is not necessary to completely embed the filler materials 17 and 18 into the solid layer 3. Rather, it is preferable that at least a portion of end portions of the filler materials 17 and 18 are outside the solid layer 3, since then the part of the filler materials 17 and 18 are fixed in the filler member 10 as will be described hereinafter. This is effective to prevent movement of the filler materials 17 and 18 from the common passage.

Then, a predetermined number (3 in FIG. 11) of land forming portions are digged (23), so that the second solid layer 21 is formed. In this case, as described hereinbefore, the solid layers 3 and 22 are formed simultaneously. In the following description, the separate formations of the solid layers are taken.

For the formation of the land forming holes, the similar method as in the formation of the cavities 21 is usable.

The material constituting the second solid layer 22 is in the form of the material of the solid layer 3 added with the filler material (fibers). The means for forming it may be the same as the means for forming the solid layer 3. The filler material in the solid layer 22 may be fibrous filler or three dimensional filler materials. In the case of the fibrous filler materials 17, the configuration thereof preferably has a large aspect ratio, and the length thereof is preferably smaller than the diameter of the nozzle or extremely longer than the same. In addition, the length is preferably not less than the length (filter pitch) in which it is embedded in the active energy ray curing material layer 7 for formation of the lands, the wall members constituting the liquid passage or the liquid chamber.

The length of the filler material is preferably such that when it is removed from the cured layer during removal process of the second solid layer 22, it is not clogged with the nozzle or the liquid passages. The diameter of the filler is preferably not more than ⅕ of the nozzle diameter in terms of proper ink supply. More particularly, the length is not less than 1.5 times the maximum length in the cross-section of the liquid passage or not more than ½ times the minimum length of the same cross-section. In order to efficiently support the filler materials in the lands, the length thereof is desirably not less than ½ of the interval between the adjacent lands.

As for the materials of the fibrous filler, usable materials include glass fibers, rock wool, carbon fibers, various whiskers, resin fibers, metal fibers and mineral fibers. However, the materials are required not to be deformed by, dissolved in or reacted with the solid layer 3, the solid layer 3 removing liquid, the active energy ray curing material layer or the cured layer removing liquid.

More particularly, as the filler materials, "ALMAX (trade name, available from Mitsui Kozan Kabushiki Kaisha), SIFER (trade name, available from Kabushiki Kaisha Kobe Seikosho), YARN (available from Asahi Fiber Glass Kabushiki Kaisha), are usable.

The content of the filler material is preferably 0.1–50% by weight on the basis of the resin material from the standpoint of the mechanical strength of the lands.

The three dimensional configuration filler material 18 will be described. In this case, the large aspect ratio is desirable since it results in low resistance against flow. The material desirably has high particle size selectivity, high chemical resistance, high mechanical strength. From these standpoints, the three dimensional configuration filler is preferably various whisker materials. As for the whisker material in the form of three dimensional filler includes PANATETRA (trade name, available from Matsushita Sangyo Kiki Kabushiki Kaisha) having a configuration extending from the center of a regular tetrahedron to the apexes thereof, for example. In the case of the three dimensional filler, the maximum length desirably satisfies the above-described preferable conditions in the case of the fibrous filler material. The contents thereof in the resin material are preferably the same as in the case of the fibrous filler material.

In this embodiment, the solid layers are provided for both of the liquid passage and the liquid chamber forming portions, but this is not inevitable, and it will suffice if the solid layer is provided at least for the liquid passage forming portion and the filter forming portion.

Figure 11A:
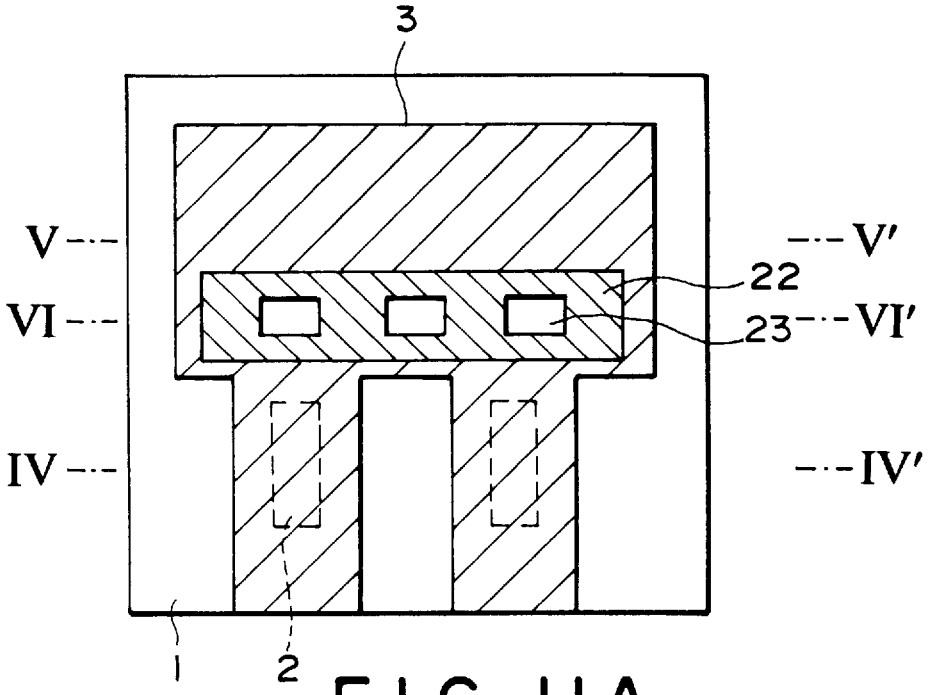
FIG. 11A is a top plan view of a first substrate after the solid layer is formed thereon.
Figure 11B:
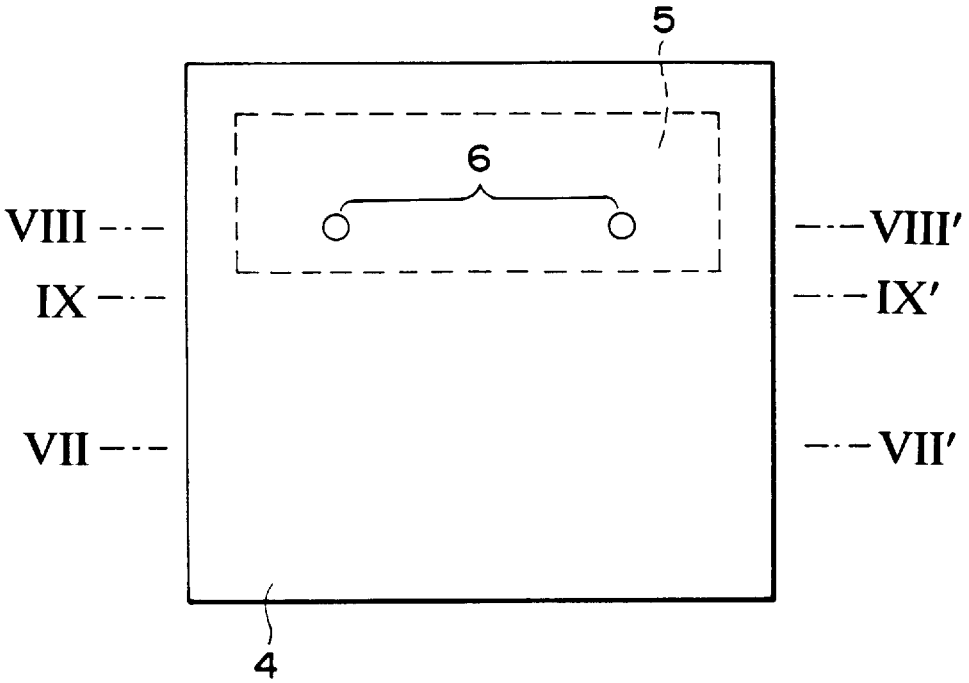
FIG. 11B is a top plan view of a second substrate.
Figure 12A:
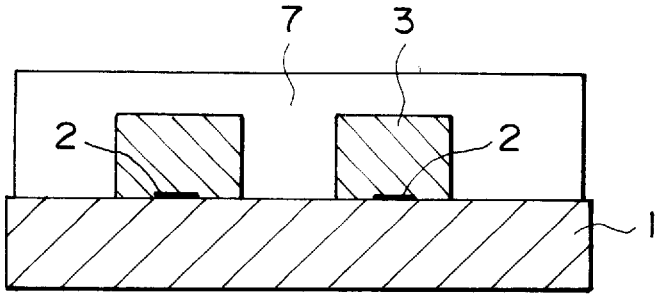
FIGS. 12A, 12B, 12C and 12D are sectional views of the first substrate of FIG. 11A after the solid layer and the active energy rays curing material are laminated thereon.
Figure 12B:
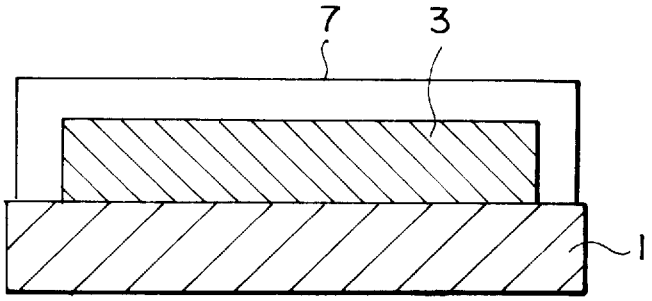
Figure 12C:
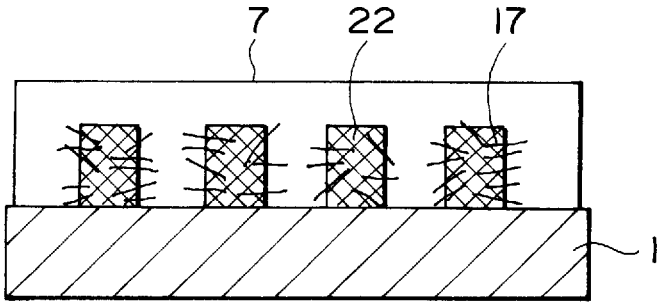

FIG. 11B shows a second substrate 4 opposed to the first substrate 1 with the filler member 10 (FIGS. 8 and 9) sandwiched therebetween. The second substrate 4, similarly to the first substrate 1, may be made of glass, plastic resin material, photosensitive resin material, ceramic material, metal or the like. When the active energy rays are projected, the second substrate 4 is required to be transmissive to the active rays. The second substrate 4 is provided with a recess 5 corresponding to the upper part of the liquid chamber 11 and the liquid supply port for communication between the top surface of the second substrate 4 and the recess 5.

The description will be made referring to FIGS. 12A, 12B, 12C, 12D, 13A, 13B, 13C, 13D, 14A, 14B, 14C, 14D, 15A, 15B, 15C and 15D. FIGS. 12A, 13A, 14A and 15A are sectional views taken along a line VII–VII' of FIG. 11B; FIGS. 12B, 13B, 14B and 15B are sectional views taken along a line VIII–VIII' of FIG. 11B; and FIGS. 12C and D, 13C and D, 14C and D and 15C and D show sectional views taken along a line IX–IX' of FIG. 11B. FIGS. 12C, 13C, 14C and 15C show the filter having the fibrous filler materials; and FIGS. 12D, 13D, 14D and 15D show the filter having the three dimensional filler materials.

The solid layers 3 and 12 are removed after the various steps which will be described hereinafter. The liquid passages and the liquid chamber are provided by the removal of the solid layer 3; and the filler is provided where the solid layer 22 is removed. The configurations of the liquid passages, the liquid chamber and the filter may be determined as desired by one skilled in the art. The solid layers 3 and 22 are desired to have the configurations corresponding to the liquid passages, the liquid chamber and the filter. In this embodiment, in order to permit ejection of ink droplets through the two ejection outlets, respectively having the ejection energy generating elements, the liquid passage is branched into two, and the liquid chamber is in communication with them in order to supply the ink to the respective passages.

Figure 12D:
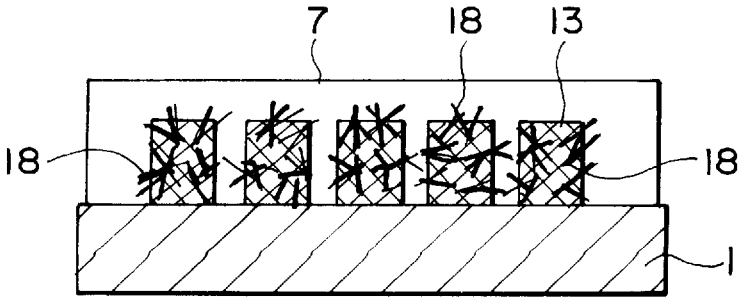

Similarly to the foregoing embodiment, the surface of the first substrate 1 having the solid layer 3 is laminated with an active energy ray curing material layer 7 so that the solid layer 3 is coated therewith, as shown in FIGS. 12A–12D. In this state, as shown in FIGS. 12C and 12D, when the solid layer 10 is formed, portions of the filler materials 17 and 18 not developed are projected from the solid layer 22 into the spaces for the formation of the lands.

The active energy ray curing or hardening material and the method of lamination in this embodiment may be the same as in the foregoing embodiment.

The end portions of the whisker materials 17 and 18 projected from the solid layers 3 and 7 are submerged in the active energy ray curing material layer 7.

Figure 13A:
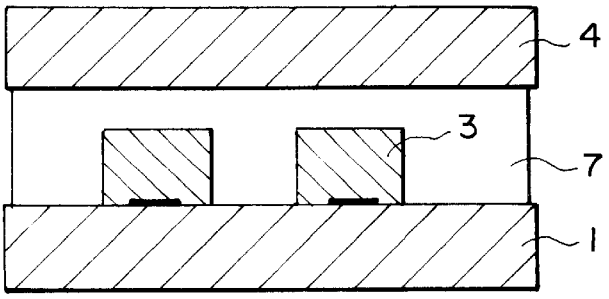
FIGS. 13A, 13B, 13C and 13D are sectional views after the second substrate of FIG. 11B is laminated.
Figure 13B:
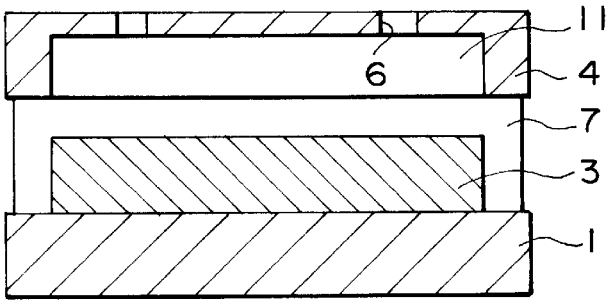
Figure 13C:
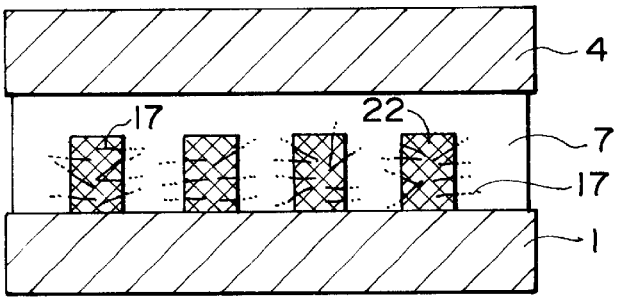
Figure 13D:
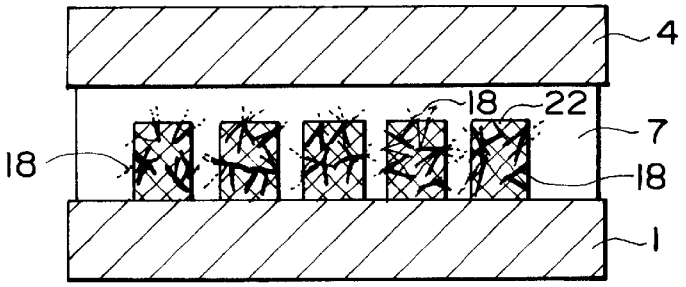
Figure 14A:
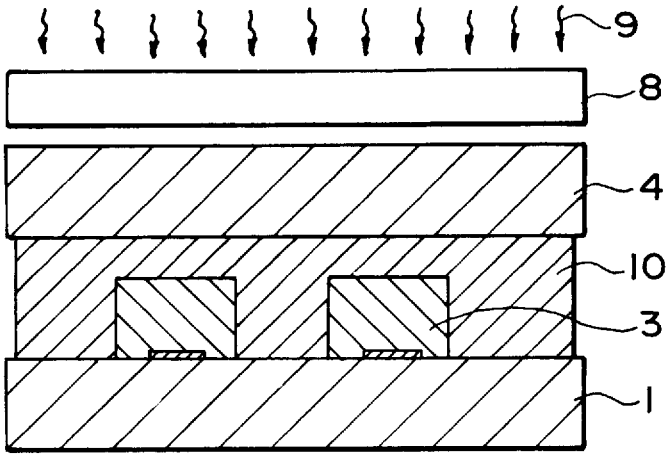
FIGS. 14A, 14B, 14C and 14D are sectional views when the rays are projected through the mask.
Figure 14B:
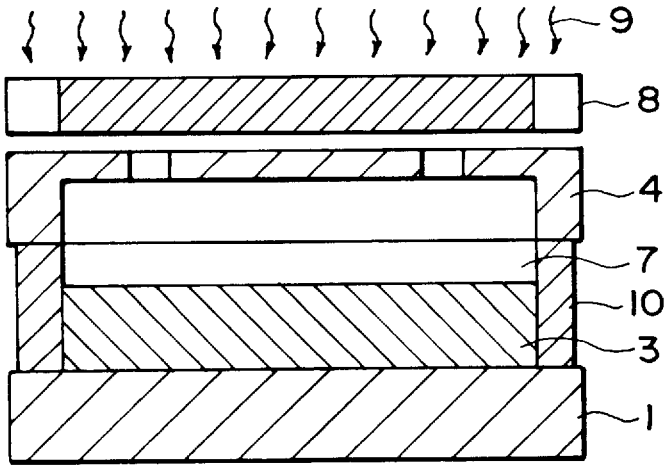
Figure 14C:
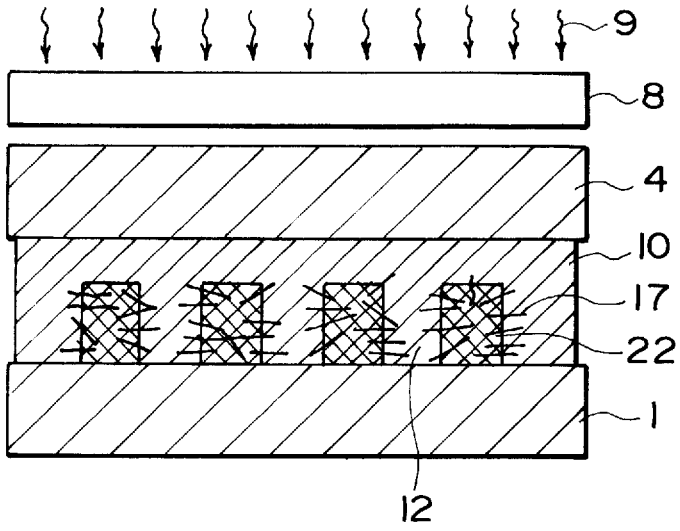
Figure 14D:
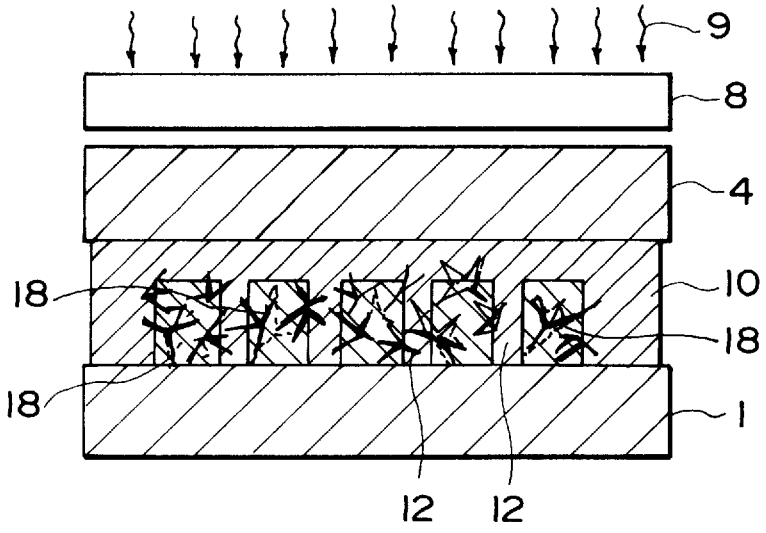
Figure 15A:
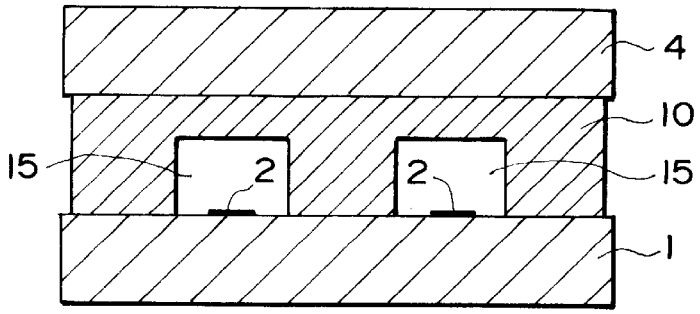
FIGS. 15A, 15B, 15C and 15D are sectional views of the laminated structure of FIGS. 11A and 11B after the solid layer and the curing material are removed.
Figure 15B:
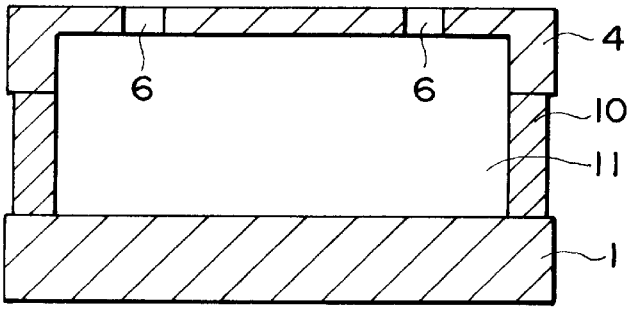
Figure 15C:
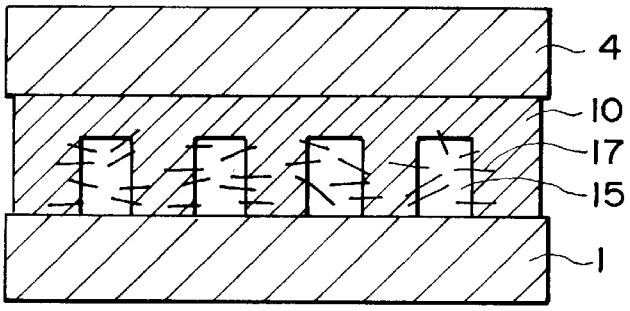
Figure 15D:
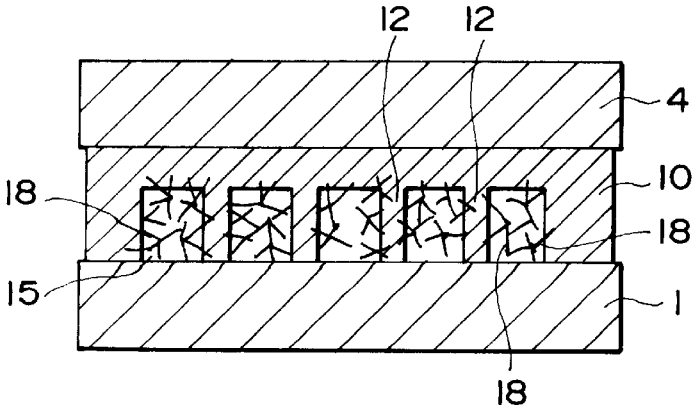

Subsequently, as shown in FIGS. 13A, 13B and 13C, the second substrate 4 (top plate) is laminated on the active energy ray curing material layer 7 on the first substrate 1. At this time, the second substrate may be provided, if desired, with the recess 11 in the liquid chamber forming portion in order to provide a desired volume of the liquid chamber. The method and order of lamination between the active energy ray curing material layer 7 and the second substrate 4 may be the same as in the foregoing embodiment.

Thus, the lamination comprising the first substrate 1, the solid layer 3, the active energy ray curing material layer 7 and the second substrate 4, is provided. Then, as shown in FIGS. 14A–14D, a mask 8 is laminated on the second substrate 4 to cover the liquid chamber forming portion 11 from the active energy rays 9, and the active energy rays are applied to the top of the mask 8.

As to the active energy rays used in the exposure process, the mask, and formation of the ejection outlet surface after the exposure process, the foregoing embodiment applies.

Subsequently, the solid layers 3 and 22 are removed from the lamination after being exposed to the energy rays in the similar manner as in the foregoing embodiment. As a result, the liquid passages 15, the liquid chamber 11, the ejection outlet 16 and the common liquid passage 14 are integrally formed by the filling material 10. Therefore, the ink jet recording head shown in FIGS. 8 and 9 is manufactured.

Here, the description will be made as to the liquid chamber 11. The portion corresponding to the thickness of the solid layer 3 at the lower portion of the liquid chamber 11 is provided by the provision of the solid layer 3, and the portion corresponding to the recess 5 formed in the second substrate 4 above the liquid chamber 11 is provided by the recess 5. The rest portion of the liquid chamber 11, that is, the portion corresponding to the active energy ray curing material layer 7, is provided by the exposure to the active energy rays 9 with the provision of the mask 8 corresponding to the liquid chamber 11. In other words, the portion becoming the wall of the liquid chamber 11 is exposed to the energy rays to be cured and becomes a part of the filling material 10. The uncured portion by being covered with the mask 8 is removed to become the rest portion of the liquid chamber 11.

Since the solid layer 3 is not laminated on the portion corresponding to the lands 12 of the common liquid passage 14, the active energy ray curing material layer 7 flows into this portion, and therefore, the lands are formed. The solid layer 3 at the portions corresponding to the space between the lands 12, the filler materials 17 and 18 are mixed. The filler materials 17 and 18 are not removed to constitute a mesh filter for the ink. If the end portions of the filler materials 17 and 18 are extended beyond the solid layer 3, the end portions are immersed in the active energy ray curing material layer 7, and therefore, they are securedly fixed in the filling material 10.

Examples of the recording heads having the filler filter will be further described.

EXAMPLE 4

The liquid jet recording head having the filter comprising the fibrous filler materials shown in FIG. 8 was manufactured through the process steps shown in FIGS. 10–15D.

First, an electrothermal transducer (made of $HfB_2$) as a liquid ejection energy generating element was formed on a glass substrate having a thickness of 1.1 mm as a first substrate. Then, a photosensitive layer having a thickness of 50 microns of a positive type dry film "OZATAC R225" (available from Hoechst Japan Co. Ltd.) was laminated onto the first substrate 1. It is exposed to ultraviolet rays of 300 $mJ/cm^2$ through a mask having filter forming portions. It was then developed with sodium hydroxide of 1%. By doing so, cavities are formed in the first solid layer. On the other hand, the positive dry film is dissolved in acetone, and highly pure alumina fibers "ALMAX" (available from Mitsui Kozan Kabushiki Kaisha) having fiber length of 40 microns approximately are mixed thereinto. The mixture is applied to the cavities of the first solid layer by dispenser. A mask of a pattern is overlaid on the photosensitive layer. The ultraviolet rays of 70 $mJ/cm^2$ were projected to the portion where the liquid passages, the liquid chamber and the filters are to be formed. The length of the liquid passage was 3 mm. Then, the spray development was carried out using a sodium methasilicate aqueous solution of 5%, by which a relief solid layer having a thickness of about 50 microns was formed in the liquid passage and liquid chamber forming portions on the glass substrate including the electrothermal transducers.

Three substrates on each of which the solid layer had been laminated were formed in accordance with the procedure similar to the above. Active energy ray hardening liquid material shown in Table 3 was laminated onto the substrates formed with the solid layers. The operating procedures were as follows.

Each of the active energy ray hardening material of A–C in Table 3 was mixed to the catalyst and was defoamed using a vacuum pump. Thereafter, the three defoamed materials were applied on the first substrates on which the solid layers had been laminated so as to have a thickness of 70 microns from the upper surfaces of the substrates by using an applicator.

Next, a glass substrate as a second substrate having a thickness of 1.1 mm was laminated on each of the first substrates on which the foregoing three kinds of active energy ray hardening materials had been laminated in accordance with the position of the liquid chamber forming portion. Each of the glass substrates has a concave portion of a depth of 0.3 mm in the liquid chamber forming portion and a through hole (liquid supply port) to supply the recording liquid at the center of the concave portion.

Subsequently, a film mask was adhered onto the upper surface of the second substrate of the laminate. The light beams were applied to the top of the liquid chamber forming portion with the extra-high pressure mercury lamp "UNIARC" (trade name, available from Ushio Denki Kabushiki Kaisha) while shielding the liquid chamber forming portion against the active energy rays. At this time, the integrated intensity of light near 365 nm was 1000 $mW/cm^2$. Next, the film mask was removed and the orifices were cut such that the electrothermal transducer element is located at the position away by 0.7 mm from the orifice edge, thereby forming the orifice outlet surface. The three laminates having the exposed orifice or ejection outlet surfaces were each dipped in ethanol. Ethanol was filled in the liquid chamber. The dissolving and removing process were executed in the ultrasonic cleaner bath for about three minutes in the state in which the ejection outlet surfaces are in contact with the ethanol. After completion of the dissolution and the removal, the cleaning was performed using an NaOH aqueous solution of 5% and pure water. Thereafter, those laminates were dried and exposed at the rate of 10 $J/cm^2$ by use of the high pressure mercury lamp. In this way, the active energy ray hardening materials were completely hardened.

The residue of the solid layer did not exist at all in any of the liquid passages of the three liquid jet recording heads which had been made as described above. Further, these heads were attached to the recording apparatus, and the recording operation was carried out using ink for ink jet comprising pure water/glycerol/direct black 154 (water-soluble black dye) at 65/30/5 (weight parts). It has been confirmed that the stable printing operation was performed. The height of the liquid passages of the resultant recording head was about 50 microns, and the height of the liquid chamber was about 0.37 mm. It has been confirmed after long term ejection tests that the deviation, non-uniformity or another improper ejection or ejection failure did not occur due to the clogging of the ejection outlets. This is because of the provision of the two dimensional filter.

TABLE 3

| Symbol | Resin | Trade Name | | Catalyst | Name of Maker of the Resin |
|---|---|---|---|---|---|
| A | Epoxy resins | Cyvacure UVR-6110 | 40 parts | Triphenyl honium | Japan Union Carbide |
| | | Cyvacure UVR-6200 | 20 parts | hexafluoro- | Co., Ltd. |
| | | Cyvacure UVR-6351 | 40 parts | antimonate *1 | |
| B | Acrylic resin | Photomer 4149 | 50 parts | Benzil dimethyl | Sannopuco Co., Ltd. |
| | | Photomer 3016 | 50 parts | ketal *2 | |
| C | Unsaturated cycloacetal | Spirac T-500 | | Benzophenone *3 | Showa High Polymer |

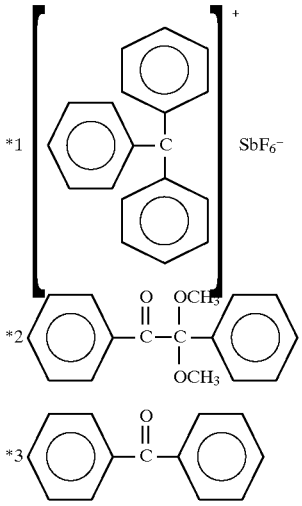

EXAMPLE 5

Example 5 will be described in which three dimensional whisker filter is used.

Similarly to the embodiment 4, electrothermal transducers (made of $HfB_2$) as liquid ejection energy generating elements were formed on a glass substrate having a thickness of 1.1 mm as a first substrate. Then, a photosensitive layer having a thickness of 50 microns consisting of a positive type dry film "OZATAC R225" (available from Hoechst Japan Co., Ltd.) was laminated on the first substrate. On the portions of the surface of the photosensitive layer corresponding to the spaces between the lands 21 of the common liquid passage 15, three dimensional whisker materials 14 having the dimension of 30–70 microns ("PANATETRA", trade name, available from Matsushita Sangyo KiKi Kabushiki Kaisha) are placed at the density of 40,000/1 $cm^2$. With this state, an after-lamination-baking operation was carried out for approximately 20 minutes at 120° C. During the baking operation, the whisker materials 14 are pressed to the positive dry film (photosensitive layer). As a result, the whisker materials 14 are mixed into the photosensitive layer. Subsequently, a mask having a configuration corresponding to the liquid passages 11, the liquid chamber 12, the ejection outlets 13 and the common liquid passage 15, is overlaid on the photosensitive layer. It is then exposed to ultraviolet rays at the energy density of 70 $mJ/cm^2$. It is spray-developed with sodium methasilicate aqueous solution of 5%, thus forming a solid layer 3 having a thickness of 50 microns on the first substrate. The length of the liquid passages 11 was approximately 3 mm.

Two hundred first substrates 1 with the laminated solid layers 3 were manufactured through the same process. Active energy ray hardening liquid material shown in the above-mentioned Table 3 were laminated on the substrates 1. A resin material and a catalyst were mixed to prepare the curing material, and the material was defoamed by a vacuum pump, and it was applied on the top surface of the first substrate using an applicator into a thickness of 70 microns.

Then, a glass substrate as a second substrate 4 having a thickness of 1.1 mm was laminated onto each of the first substrates 1 on which the active energy ray hardening materials had been laminated in alignment with the position of the liquid chamber forming portion each of the glass substrates has a recess portion of a depth of 0.3 mm in the liquid chamber forming portion and a through hole (liquid supply port) to supply the recording liquid. Subsequently, a film mask was adhered onto the upper surface of the second substrate 4 of the laminate. The light rays were projected from the above of the liquid chamber forming portion by the extra-high pressure mercury lamp "UNIARC" (available from Ushio Kabushiki Kaisha) while shielding the liquid chamber forming portion against the active energy rays, thus hardening the hardening material layer 7. The hardened portion becomes the filling material 10. At this time, the irradiated intensity of the light near 365 nm of the wavelength was 1000 mW/cm$^2$. Thereafter, the film mask was removed, and the orifice was cut such that the electrothermal transducers are located at the position away by 0.7 mm from the orifice edge, thereby forming the orifice or ejection outlet surface.

The laminates having the exposed ejection outlet surfaces were dipped in ethanol, so that the solid layer 3 and the unhardened portion of the hardening material layer 7 were dissolved and removed. The dissolving the removing processes were carried out in an ultrasound cleaner bath for about three minutes in the state in which the ejection outlets 10 are kept in contact with the ethanol by supplying the ethanol into the inside of the laminate through the liquid supply port 6 of the second substrate 4. After the completion of the dissolution and removal, the cleaning was performed using an NaOH aqueous solution of 5% and pure water. After the cleaning, the laminates were dried and exposed at the integrated rate of 10 J/cm$^2$ by use of the high pressure mercury lamp. In this way, the filling material 10 was completely hardened. No residue of the solid layer is observed in the liquid passages of any of 200 ink jet recording heads.

The 200 recording heads were attached to the recording apparatus, and the recording operation was carried out using ink for ink jet comprising pure water/glycerol/direct black 154 (water-soluble black dye) at 65/30/5 (parts by weight). With the operations the clogging of the liquid passages 15 and the frequency of the occurrences of improper ink ejections are checked. The results are shown in Table 4. The dimension of the ejection outlets 13 was 50×50 microns. The clearance between the lands 12 of the common liquid passage 14 (apertures of the filter) was 30 microns in width and 50 microns in height.

TABLE 4

| | Filter apertures ($\mu$m$^2$) (width × height) | Nozzle clogging*2 (bits/head) | Printing | |
|---|---|---|---|---|
| Ex. 1 | 1500*1 (30 × 50) | 5/200 | No ejection*3 | 0 |
| | | | Deviation*4 | 2 |
| Comp. Ex. 8 | No filter | 57/200 | No. ejection | 14 |
| | | | Deviation | 37 |
| Comp. Ex. 9 | 1500 (30 × 50) | 7/200 | No ejection | 0 |
| | | | Deviation | 7 |

*1: The area occupied by the whisker materials are deemed 0.
*2: The clogging foreign matters in the liquid passages are observed by microscope. The data is the number of clogged nozzles per total number of recording heads.
*3: The ink is not ejected due to the clogging foreign matters (ejection failure).
*4: The clogging foreign matter impedes the ejection so that the ejecting direction is deviated.

Comparison Example 8

The common liquid passage 14 is not provided with any land. In other words, there is no portion functioning as the filter in the common liquid passage 14. In the other respects, the structures are the same as in Example 5. Two hundred of such ink jet recording heads are manufactured and the liquid passage 15 clogging and the frequency of occurrence of the improper ink ejection, were checked. The results are shown in Table 4, too.

Comparison Example 9

The ink jet recording heads of this Comparison Example is the same as that of Example 5 except that the common liquid passage 14 is provided with lands 12 without the filler materials 18. Two hundred ink jet recording heads were manufactured, and similarly to the Example 5, the liquid passage 15 clogging and the frequency of the occurrence of the improper ink ejection were checked. The results are also shown in Table 4.

As will be understood from Table 4, the ink jet recording head according to this embodiment showed remarkably better results than that of the Comparison Example 8 without any filtering structure. As compared with the Comparison Example 9 without the filler material in the common liquid passage, it has been confirmed that the substantially mesh filter provided by the three dimensional configuration filler materials are effective to assuredly preclude the foreign matters from the liquid passages.

Figure 16:
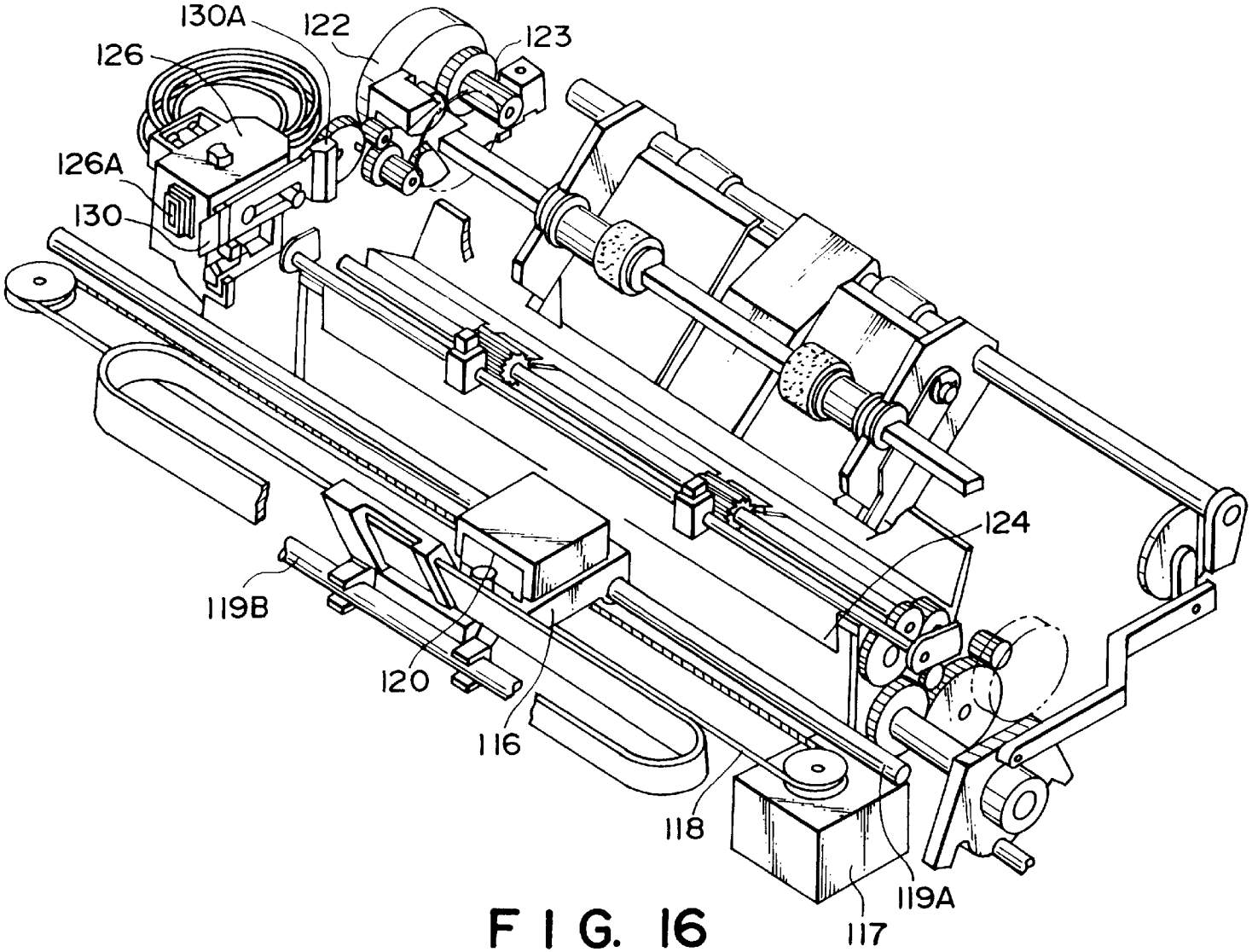
FIG. 16 PRIOR ART
FIG. 16 shows a recording apparatus usable with the recording head according to an embodiment of the present invention.

Referring to FIG. 16, there is shown an example of an ink jet recording apparatus IJRA having the ink jet recording head cartridge IJC including the recording head of this invention.

The ink jet head cartridge 20 is provided with a group of nozzles (ejection outlets) faced to the recording surface of a recording material fed to a platen 24. The ink jet head cartridge IJC (20) is carried on a carriage HC (16). It is operatively connected with a part of a driving belt 18 for transmitting the driving force from a driving motor 17. It is slidable on guiding shafts 19A and 19B arranged parallel with each other, so that the carriage 16 is reciprocable over the entire length of the recording sheet.

Designated by a reference numeral 26 is a recording head recovering device and is disposed adjacent an end of the reciprocating passage of the ink jet cartridge 20, for example, at a position facing to its home position. By the driving force from the motor 22 through the transmission mechanism 23, the head recovery device 26 is operated to cap the ink jet cartridge 20. In association with the capping of the ink jet cartridge 20 by the capping portion 26A of the head recovery device 26, a sucking means in the head recovery device 26 sucks the ink, or a proper pressing means provided in an ink supply passage to the ink jet head cartridge 20 applies pressure to the ink, by which the ink is forcedly discharged through the ink ejection outlets, so that the ink having the increased viscosity in the nozzles are removed. After the completion of the recording operation, or the like, the ink jet head cartridge 20 is protected by being capped.

A wiping member in the form of a blade 30 made of silicone rubber is disposed to the side of the head recovery device 26. A blade 31 is supported by a cantilever on a blade supporting member 31A, and is operated by a motor 22 and the transmission mechanism 23, similarly to the head recovery device 26, so that it becomes engageable to the ejection side surface of the ink jet recording head cartridge 20. By doing so, at proper timing in the recording operation of the cartridge 20 after the recovery process operation of the recovery device 26, the blade 31 is projected into the movable passage of the ink jet recording head 20. By movement of the cartridge 20, the dew liquid, wetting or the dusts are wiped from the ejection side surface of the cartridge 20.

The ink jet cartridge may contain the recording head and the integral ink container. Or, it may contain the recording head only, to which the ink container is detachably mountable.

Figure 17:
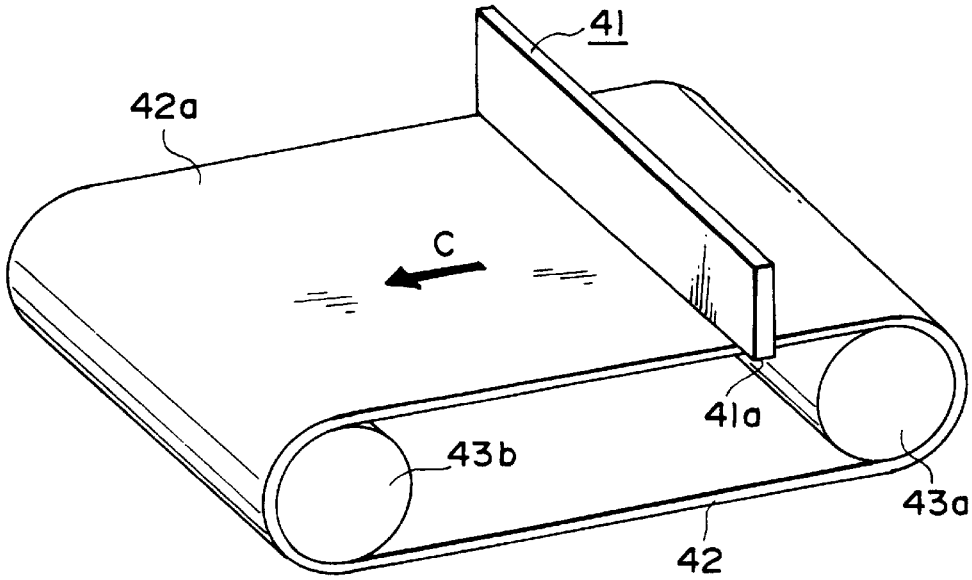
FIG. 17 PRIOR ART
FIG. 17 shows a recording apparatus usable with the recording head according to another embodiment of the present invention.
Figure 18:
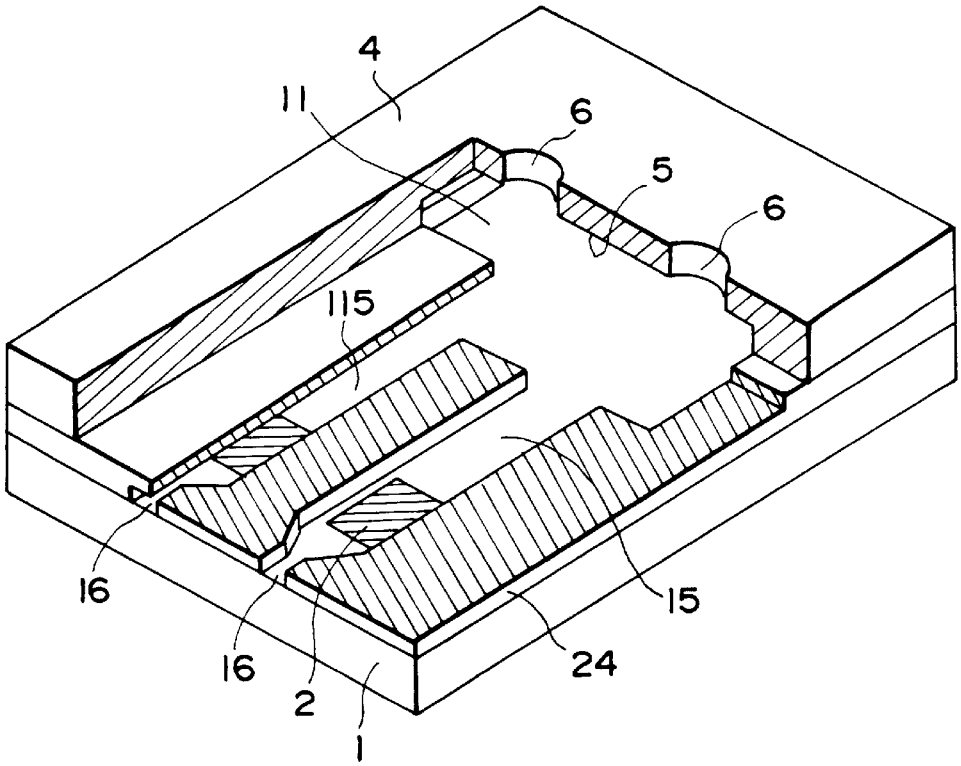
FIG. 18 PRIOR ART
FIG. 18 is a sectional view of a recording head not using the present invention.
Figure 19:
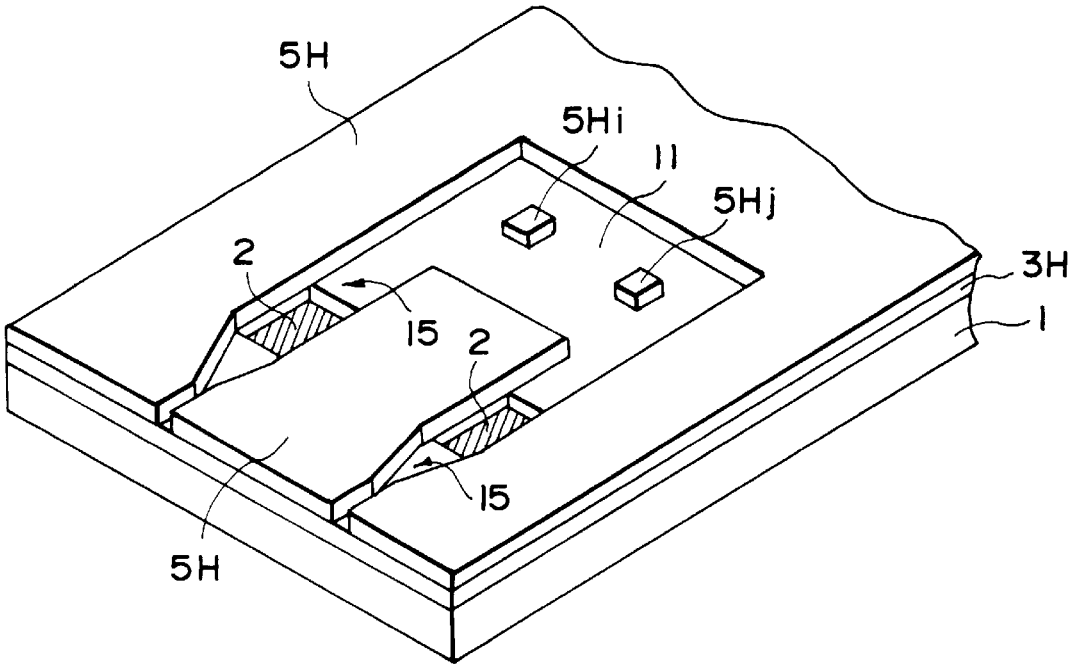
FIG. 19 PRIOR ART
FIG. 19 illustrates the manufacturing of the recording head
Figure 20:
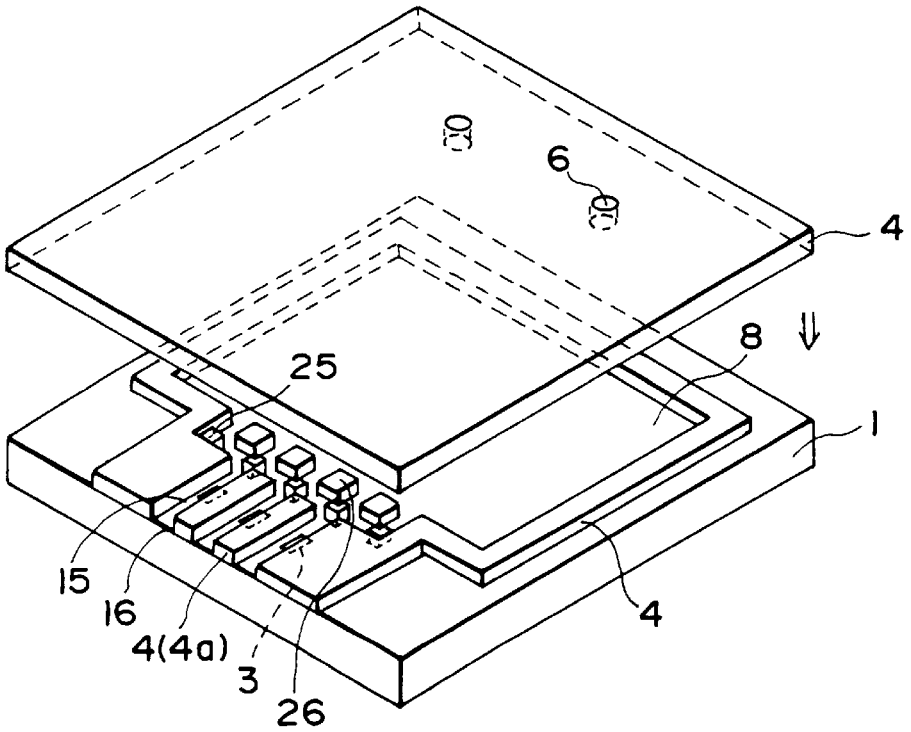
FIG. 20 PRIOR ART
FIG. 20 is a sectional view illustrating another manufacturing method not using the present invention.

Referring to FIG. 17, another embodiment of the ink jet recording apparatus will be described. In FIG. 17, only the major part of the ink jet recording apparatus is shown in perspective view. A recording head 41 for ejecting ink in accordance with recording signals to provide a desired image has the same structure as described in the above embodiments. A great number of ejection outlets are formed in the range covering the entire recording width for the recording material (full-line type). It is manufactured through the process described in the foregoing.

The recording head 41 is mounted in an unshown main assembly of the ink jet recording apparatus. The ejection side surface 41*a* in which the number of ejection outlets are formed in a line, is spaced apart from a conveying surface 42*a* of the conveying belt 42 by a predetermined gap.

The conveying belt 42 is extended around two rollers 43*a* and 43*b* rotatably supported on the main assembly of the ink jet recording apparatus. At least one of the rollers is rotated to rotate the belt 42 in the direction indicated by an arrow C.

The recording material is fed to the conveying belt 42 from an unshown sheet feeding station (right side of the drawing) and is attracted on the conveying surface 42*a* of the belt 42 to pass the recording material through the gap between the ejection side surface 41*a* of the recording head 41 and the conveying surface 42*a*. At this time, the ink is ejected through the ejection outlets of the recording head 41 so that the images are recorded.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing a pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or suction means, and preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower then 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

According to the present invention described above, various advantageous effects are provided. During the ink ejection actions, the foreign matters having sizes larger than the cross-sectional area of the ejection outlets are blocked by the apertures of the filter, and therefore, the foreign matters are prevented from reaching the neighborhood of the ejection outlets, so that the improper ejection occurrence can be significantly reduced. The apertures of the filter are effective to limit the flow of the ink, and therefore, even when the ink jet recording head is strongly vibrated, the leakage of the ink through the ejection outlets and the improper ink ejection attributable to the back-flow of the ink to the ink container, can be prevented.

In the ink jet recording head manufacturing method, during the formation of the ejection outlets and the liquid passages, the apertures functioning as the filter are integrally formed through the same manufacturing process. Therefore, the ink jet recording heads of this invention can be manufactured without increasing the number of process steps and without increase of the number of parts. As compared with the case of using separate filter, the manufacturing cost and the number of parts can be reduced.

According to the ink jet recording head and the manufacturing method therefor using the filler filter, the filter in the form of a mesh is integrally formed with the nozzle portions for ejecting the ink, and therefore, there is no need of increasing the number of parts and the number of process steps, and therefore, the significant cost reduction is accomplished as compared with the case in which separately manufactured filter is used. When the filler materials are used, the filter is in the form of a mesh, and therefore, the fine foreign matters, elongated foreign matters and other solid matters can be assuredly removed without reducing the liquid supply performance and without producing variation in the liquid supply properties for the respective liquid passages and ink ejection outlets. As a result, high quality images can be stably provided. Additionally, the use of the filler material increases the structural strength of the recording head.

The ink jet recording head manufacturing method of this invention provides the following industrial advantages:

(1) Precision process is possible;

(2) The configurations of the liquid passage, the liquid chamber and the filter are not limited in terms of manufacturing process;

(3) The process does not require particular skill, and therefore, the mass-production is possible;

(4) Big choice can be enjoyed in the selection of the active energy ray hardening or curing materials, and therefore, the material exhibiting good structural material properties, can be used;

(5) Cost is low;

(6) A large liquid chamber desired by a high density multi-array type recording head, can be easily formed with the advantage of easy manufacturing suitable to the mass-production;

(7) Three dimensional filter can be integrally formed; and (8) The filter in the form of a mesh can be integrally formed, and therefore, the function and performance can be increased without changing the process.

While the invention has been described with reference to the structures disclosed herein, it is not confined to the details set forth and this application is intended to cover such modifications or changes as may come within the purposes of the improvements or the scope of the following claims.

What is claimed is:

1. A method for manufacturing an ink jet head which includes ejection energy generating elements for ejecting ink, ink passages in which the ejection energy generating elements are disposed, ink ejection outlets in communication with the ink passages, an ink chamber for supplying the ink to said ink passages, said method comprising the steps of:

preparing a substrate provided with the ejection energy generating elements;

forming, on said substrate, a solid layer having patterns corresponding to said ink passages over said ejection energy generating elements and further having patterns corresponding to said ink ejection outlets, said ink chamber and spaces between filter elements in said ink chamber;

providing in said solid layer, in the portions thereof corresponding to the spaces between said filter elements, filler materials which project out of said solid material and into the regions to be occupied by said filter elements;

forming a covering resin layer which covers the solid layer and which is to form said ink passages, walls of said ink chamber and passages between said filter elements; and removing the solid layer;

wherein a filter is formed in said ink chamber by said projected portions of said filler materials becoming fixed to said covering resin layer.

2. A manufacturing method according to claim 1, wherein the filler material includes at least one of a fibrous material and three-dimensional whiskers.

3. A method according to claim 1, wherein a cross-sectional area of the solid layer is smaller than a cross-sectional area of the ejection outlet.

* * * * *

UNITED STATES PATENT AND TRADEMARK OFFICE

CERTIFICATE OF CORRECTION

PATENT NO. : 5,808,644

DATED : September 15, 1998

INVENTOR(S) : ISAO IMAMURA ET AL.

It is certified that error appears in the above-identified patent and that said Letters Patent is hereby corrected as shown below:

Title page,

Line [56], "3202352 9/1991 Japan ..... B41J 2/05" should be deleted.

COLUMN 2

Line 30, "(orifice)" should read --(orifices)--.

COLUMN 3

Line 65, "are top plan views" should read --is a top plan view--.
Line 66, "is a" should read --are-- and "view" should read --views--.

COLUMN 4

Line 11, "FIG. 3," should read --FIG. 3B,--.
Line 18, "FIG." should read --FIGS.--.
Line 19, "FIG." should read --FIGS.--.
Line 60, "head" should read --head.

UNITED STATES PATENT AND TRADEMARK OFFICE

CERTIFICATE OF CORRECTION

PATENT NO. : 5,808,644

DATED : September 15, 1998

INVENTOR(S) : ISAO IMAMURA ET AL.

It is certified that error appears in the above-identified patent and that said Letters Patent is hereby corrected as shown below:

COLUMN 7

Line 34, "film:" should read --film.--.
Line 39, "removed:" should read --removed.--

COLUMN 8

Line 26, "is" should be deleted.
Line 56, "then," should read --them,--.
Line 62, "radical" should read --radically--.

COLUMN 10

Line 64, "13" should read --16--.

COLUMN 13

Line 14, "are" should read --area--.
Line 18, "clogs" should read --clog--.
Line 20, "taken" should read --take--.
Line 45, "VIII';" should read --VIII'--.

COLUMN 21

Line 13, "the" should read --of the--.
Line 14, "were" should read --was--.

UNITED STATES PATENT AND TRADEMARK OFFICE

CERTIFICATE OF CORRECTION

PATENT NO. : 5,808,644

DATED : September 15, 1998

INVENTOR(S) : ISAO IMAMURA ET AL.

It is certified that error appears in the above-identified patent and that said Letters Patent is hereby corrected as shown below:

COLUMN 22

Line 3, "similarly to the" should read --similarly as in--.

Signed and Sealed this

Twenty-fourth Day of October, 2000

*Attest:*

Q. TODD DICKINSON

*Attesting Officer*

*Director of Patents and Trademarks*